US009335033B2

(12) United States Patent
Gagne et al.

(10) Patent No.: US 9,335,033 B2
(45) Date of Patent: May 10, 2016

(54) CEILING SUPPORT SYSTEM AND APPARATUS

(75) Inventors: Jean-Guy Gagne, Etobicoke (CA); James W. Rogers, Toronto (CA)

(73) Assignee: BRAINWAVE RESEARCH CORPORATION, Ontario (CA)

( * ) Notice: Subject to any disclaimer, the term of this patent is extended or adjusted under 35 U.S.C. 154(b) by 724 days.

(21) Appl. No.: 13/563,380

(22) Filed: Jul. 31, 2012

(65) Prior Publication Data

US 2013/0037502 A1 Feb. 14, 2013

Related U.S. Application Data

(60) Provisional application No. 61/522,475, filed on Aug. 11, 2011.

(51) Int. Cl.
*F21V 21/04* (2006.01)
*E04B 9/06* (2006.01)

(52) U.S. Cl.
CPC ..... *F21V 21/048* (2013.01); *E04B 9/06* (2013.01); *E04B 9/064* (2013.01)

(58) Field of Classification Search
CPC ..... F21V 21/03; F21V 21/048; F21V 21/049; F21V 21/041; F21V 21/044; F16M 13/02; E04B 9/06; E04B 9/064
USPC ..... 248/201, 200.1, 205.1, 200, 342, 343, 248/318, 317, 324; 52/506.06, 506.07, 52/506.08; 362/150, 148, 147, 145, 365, 362/371
See application file for complete search history.

(56) References Cited

U.S. PATENT DOCUMENTS

| | | | | | |
|---|---|---|---|---|---|
| 2,586,327 | A * | 2/1952 | Haertel | 52/506.09 | |
| 3,233,297 | A * | 2/1966 | Havener | 403/397 | |
| 3,336,711 | A * | 8/1967 | Menke | 52/364 | |
| 3,832,816 | A * | 9/1974 | Jahn | 52/779 | |
| 4,041,668 | A * | 8/1977 | Jahn et al. | 52/506.09 | |
| 4,161,019 | A * | 7/1979 | Mulvey | 362/147 | |
| 4,431,151 | A * | 2/1984 | Schonasky | 248/27.1 | |
| 4,432,182 | A * | 2/1984 | Addie et al. | 52/480 | |
| 4,455,806 | A * | 6/1984 | Rice | 52/404.1 | |
| 4,463,537 | A * | 8/1984 | Rodriquez et al. | 52/506.07 | |
| 4,705,255 | A * | 11/1987 | Reed, Jr. | 248/317 | |
| 4,848,054 | A * | 7/1989 | Blitzer et al. | 52/506.07 | |
| 5,311,719 | A * | 5/1994 | Jahn | 52/506.09 | |
| 5,377,088 | A * | 12/1994 | Lecluze | F21V 21/04 248/343 | |
| 6,467,228 | B1 * | 10/2002 | Wendt et al. | 52/506.07 | |
| 6,843,033 | B2 * | 1/2005 | Okumura | 52/506.07 | |
| 6,892,500 | B2 * | 5/2005 | Zaborowski | 52/506.06 | |
| 7,143,562 | B2 * | 12/2006 | Krantz-Lilienthal et al. | 52/506.06 | |
| 7,392,629 | B1 * | 7/2008 | Bankston et al. | 52/506.07 | |
| 7,578,106 | B2 * | 8/2009 | Burns et al. | 52/506.06 | |
| 7,637,065 | B2 * | 12/2009 | Ahren et al. | 52/506.06 | |
| 7,658,047 | B2 * | 2/2010 | Bankston et al. | 52/506.07 | |
| 7,743,572 | B2 * | 6/2010 | Ducharme | 52/506.06 | |
| 2003/0192268 | A1 * | 10/2003 | Zaborowski | 52/220.6 | |
| 2006/0005495 | A1 * | 1/2006 | Stessel et al. | 52/506.07 | |
| 2008/0289280 | A1 * | 11/2008 | LaLonde | 52/506.07 | |
| 2011/0011023 | A1 * | 1/2011 | Gulbrandsen et al. | 52/506.07 | |
| 2013/0333317 | A1 * | 12/2013 | Lehane et al. | 52/506.06 | |
| 2015/0059279 | A1 * | 3/2015 | Harper et al. | 52/506.06 | |

* cited by examiner

*Primary Examiner* — Nkeisha Smith
(74) *Attorney, Agent, or Firm* — Ditthavong & Steiner, P.C.

(57) ABSTRACT

A ceiling support system includes a bracket mechanism that can be attached to ceiling joists. An upwardly extending flange arrangement provides support for a ceiling fixture while allowing adjustment of its position before being secured to the support system. The flange arrangement may be flexible and secured to the ceiling structure via resilient hangers.

10 Claims, 26 Drawing Sheets

CEILING SUPPORT SYSTEM AND APPARATUS

This disclosure contains subject matter in common with provisional application 61/522,475, filed Aug. 11, 2011 by applicants Jean-Guy Gagne and James W. Rogers. The benefit of provisional application 61/522,475 is claimed under 35 U.S.C. 119(e).

BACKGROUND

This disclosure is related to installation of ceiling fixtures that are to be recessed above ceiling substrates, such as, for example, "pot" light fixtures. Installation of such fixtures has traditionally involved a cumbersome procedure. A fixture must be physically held while aligning it in position and attaching it to the ceiling structure. Adjustment of fixture position without adequate support structure impedes maneuverability. Requirements for horizontal placement of the fixture as well as its depth dimension need to be considered. Once a fixture is nailed to a metal stud or joist, flexibility to meet alignment requirements is lost. Although fixtures may include mounting arms, there has not been an easy way to fasten the arms to the ceiling.

A need exists for the ability to determine spacing of a fixture and to maneuver the fixture until satisfied with its layout before securing it in position. A mechanism for containing the fixture while such adjustment is undertaken would be desirable. Such a mechanism should be capable of easy permanent attachment, both to the fixture and the ceiling structure.

Additional needs for improvement exist for simplifying depth adjustments. Installation resiliency should be considered to avoid vibration of the ceiling substrate and to counteract joist height irregularity.

SUMMARY OF DISCLOSURE

The needs described above are fulfilled, at least in part, by a ceiling support system that includes a bracket mechanism having a base surface that can be attached to ceiling joists, for example, at the bottom surfaces thereof. A flange extends upwardly from the base surface in a direction generally parallel to the joists. The base surface and flange can provide support for the fixture, which can be slid along a length of the bracket mechanism to adjust its position before permanent attachment.

The bracket mechanism may form a generally rectangular frame with the flange spaced from the joists at two opposite sides to define channels along the joists when engaged thereto. The flange may be discontinuous at rectangular corners of the frame for ease of construction. A fixture may be slid along the channels in a direction parallel to the joists to adjust its position. Alternatively, or in addition, the fixture may be slid along a length of the base and flange surface in a direction generally perpendicular to the joists. The fixture can be secured to the bracket after adjusted to position. The fixture may include one or more support arms that can be used to facilitate engagement with the bracket mechanism. The mechanism may include an interface between the frame and an element extending from a fixture arm.

In an alternative arrangement, the bracket mechanism may include a rail for each opposing side of adjacent joists. A second flange extends from a second side of the base surface in the upward direction to define a rail channel capable of supporting a fixture. The second flange of each rail can be mounted to a side of the corresponding joist. The rails are of sufficient length to slidably adjust position of one or more supported fixtures along rail channels. Length gradient demarcations may be provided on the rails to facilitate proper length determination. The fixtures thereafter can be secured to the rails at the adjusted positions. The base surface may extend laterally beyond the second flange so that the extended base portion can be flush with a bottom surface of a corresponding joist during fixed engagement with the joist, thereby enabling proper alignment between the rail and the joist.

In a further alternative arrangement, a plurality of flexible channel structures can be engaged with respective ceiling joists for resiliently supporting at least one ceiling fixture. Each channel structure comprises a joist mounting surface and a pair of parallel channels interconnected by the joist mounting surface. One of the channels includes a substrate mounting surface for contact with and support of a ceiling substrate. The substrate mounting surface is downwardly displaced from the joist mounting surface. Each channel can be engaged with a ceiling fixture to provide resilient support thereof. The second one of the channels contains a fixture support surface that is downwardly displaced from the joist mounting surface. The substrate mounting surface and the fixture support surface are each joined to the joist mounting surface by an upwardly sloping element, one or both of which embodying a flexibility characteristic for providing resiliency to the system. Each channel comprises an upwardly extending flange remote from the joist mounting surface.

A fixture may be supported by the channel structure and slid along its length of the channel to adjust fixture position. An interface between an upwardly extending flange of a channel structure and an element extending from the fixture provides for easy engagement. Each upwardly extending flange may include a hemmed end to provide vertical retention to the fixture element.

In another alternative, a resilient ceiling support system includes a plurality of flexible channel structures for resiliently supporting at least one ceiling fixture, such as a "pot" light. Each channel structure comprises a generally u-shaped channel having a substrate mounting surface for contact with and support of a ceiling substrate. Side walls of each u-shaped channel extend upwardly from the substrate mounting surface. An upper end of each side wall includes a hem that forms a downwardly facing slot with respect to the side wall. A plurality of flexible hanger assemblies interfaces with corresponding channels. Each hanger assembly includes a joist mounting portion for attachment to a ceiling joist. An upwardly extending mating portion of each hanger assembly can mate with a sidewall slot to provide support for the u-shaped channel.

The joist mounting portion of the hanger assembly includes a surface thereof that is capable of flush attachment to the bottom surface of a joist. The hanger assembly may contain a sloped portion interconnected between the joist mounting portion and the mating portion. The sloped portion embodies a flexibility characteristic that provides resiliency to the system. In a variation of this arrangement, the joist mounting portion may be of generally rectangular configuration for attachment at one end thereof to the bottom of a joist. A retainer at a remote end is configured to interface with slots of a u-shaped channel.

In yet another variation, the joist mounting portion may be of a relatively planar configuration for attachment to a side of a corresponding joist. A cantilevered element of the hanger assembly is connected at one end thereof to the joist mounting portion. The cantilevered element may be comprised of elastomeric material. Hanger hooks proximate a second end of the cantilevered element are configured to interface with slots of a u-shaped channel. An elastomeric isolator, including hanger hooks, may be coupled to the second end of the cantilevered element. As an additional alternative, a retainer element may be engaged with the isolator, the retainer element comprising hanger hooks.

A locking mechanism may be employed to fix the position of the fixture to the u-shaped channel. For example, a barbed retainer can extend over the hem of a channel to engage the channel with support structure of the fixture. A rotatable wedge or a clip may be provided to ensure attachment.

BRIEF DESCRIPTION OF DRAWINGS

Various exemplary embodiments are illustrated by way of example, and not by way of limitation, in the figures of the accompanying drawings in which like reference numerals refer to similar elements and in which.

DETAILED DISCLOSURE

Figure 1A:
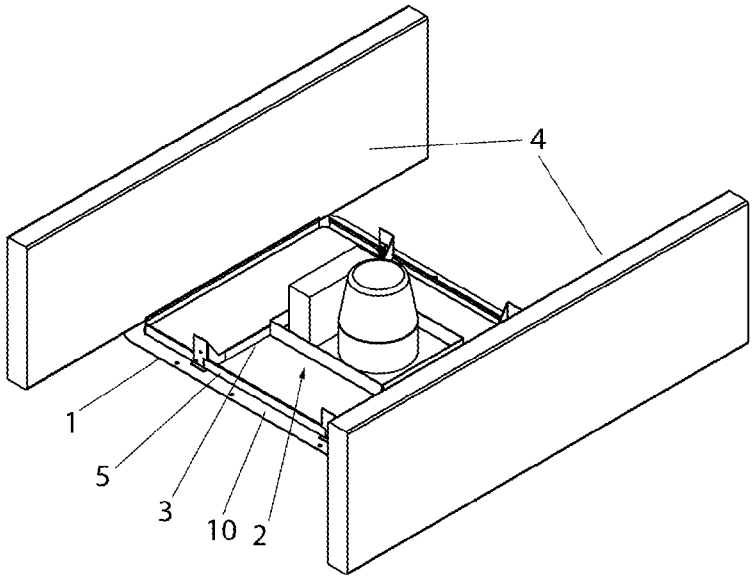
FIG. 1*a* is a perspective view of a preferred embodiment of a bracket fixed to two parallel ceiling joists supporting a fixture.
Figure 1B:
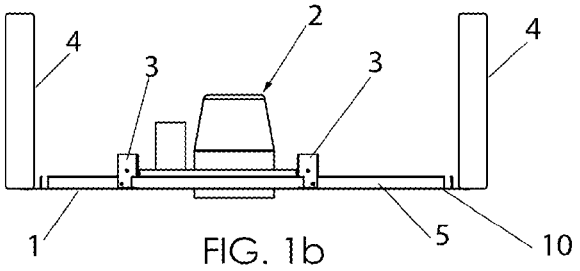
FIG. 1*b* is an elevation view of the bracket installation shown in FIG.1*a;*
Figure 1C:
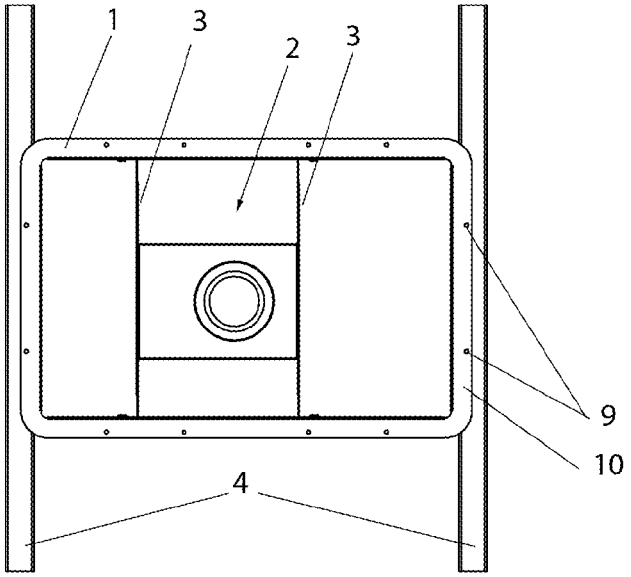
FIG. 1*c* is a bottom view of the bracket installation shown in FIG. 1*b;*
Figure 1D:
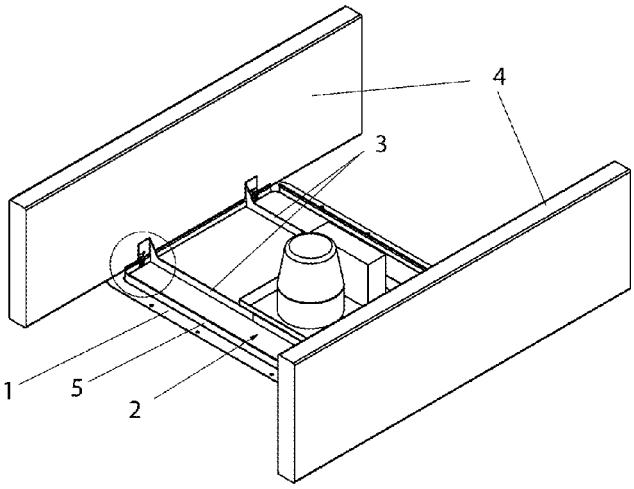
FIG. 1*d* is a perspective view of an alternative bracket installation.

Referring to FIGS. 1*a*-1*c*, bracket 1 is fixed to two parallel ceiling joists 4 for supporting a fixture 2, exemplified by a pot light having support arms 3. Installation may occur during a rough-in stage of new construction, the base 10 of bracket mount to ceiling joists 4 with fasteners 9. The support arms 3 of pot light 2 are hung on the vertical flange elements 5 of bracket 1 that are parallel to the joists. Once supported by bracket 1, pot light 2 can be moved horizontally, in a direction parallel with the joists, within bracket 1 to its optimum position prior to being fixed in place with screws or other attachment devices. The bracket 1 may be fixed on joists 4 that are spaced, for example at twenty-four inch centers. The width of the bracket may be dimensioned to accommodate joists spaced differently, for example at sixteen inch centers with the position of the bracket rotated by ninety degrees.

Figure 1E:
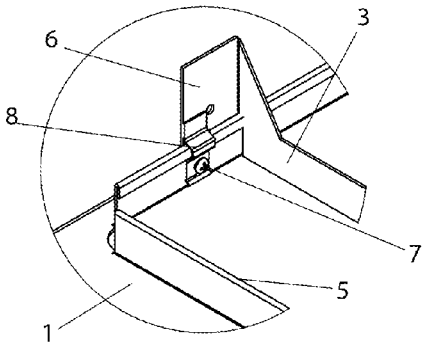
FIG. 1*e* is a detail view of a portion of FIG. 1*d;*
Figure 1F:
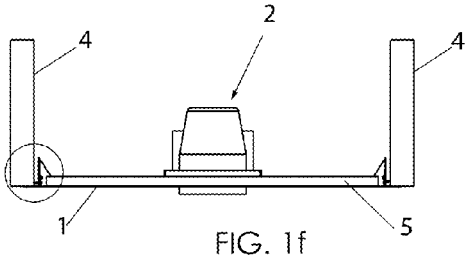
FIG. 1*f* is an elevation view of the bracket installation shown in FIG. 1*d;*
Figure 1G:
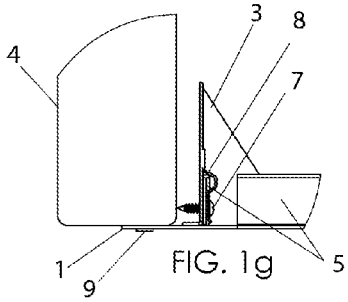
FIG. 1*g* is a detail view of a portion of FIG. 1*f;*
Figure 1H:
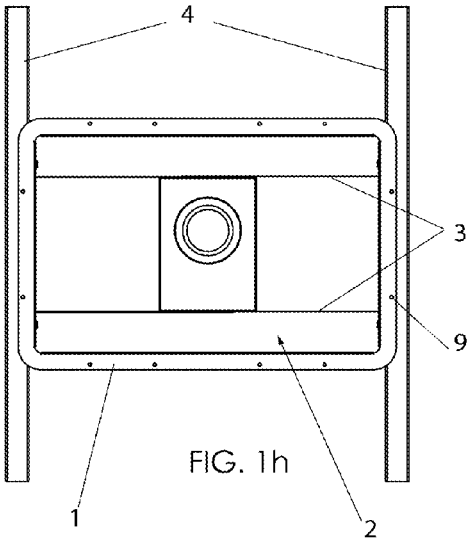
FIG. 1*h* is a bottom view of the bracket installation shown in FIG. 1*f*
Figure 1I:
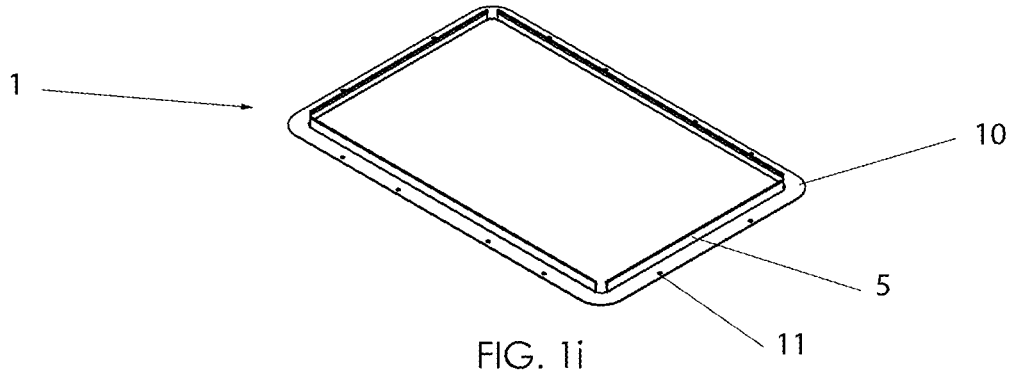
FIG. 1*i* is a perspective view of the bracket shown in FIGS. 1*a*-1*h;*
Figure 1J:
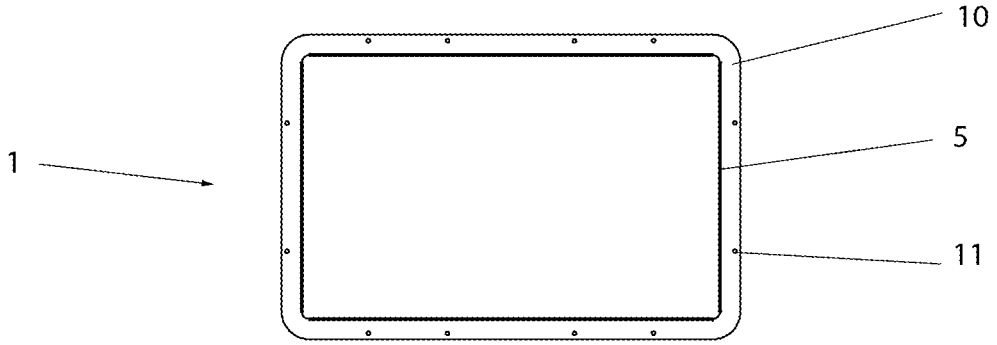
FIG. 1*j* is a plan view of the bracket shown in FIG. 1*i;*
Figure 1K:
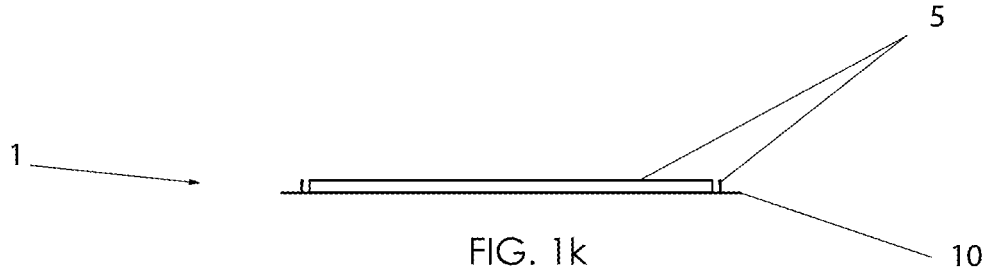
FIG. 1*k* is an elevation view of the bracket shown in FIG. 1*j;*
Figure 2A:
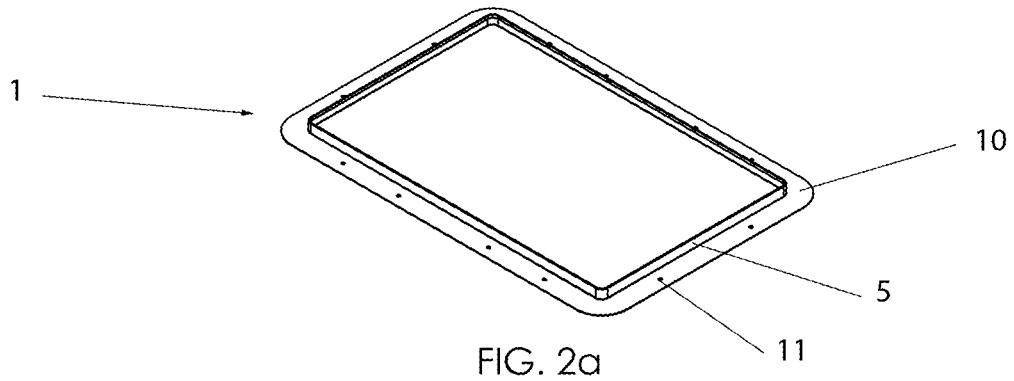
FIG. 2*a* is a perspective view of an alternative preferred embodiment of the bracket shown in FIG. 1*i;*
Figure 2B:
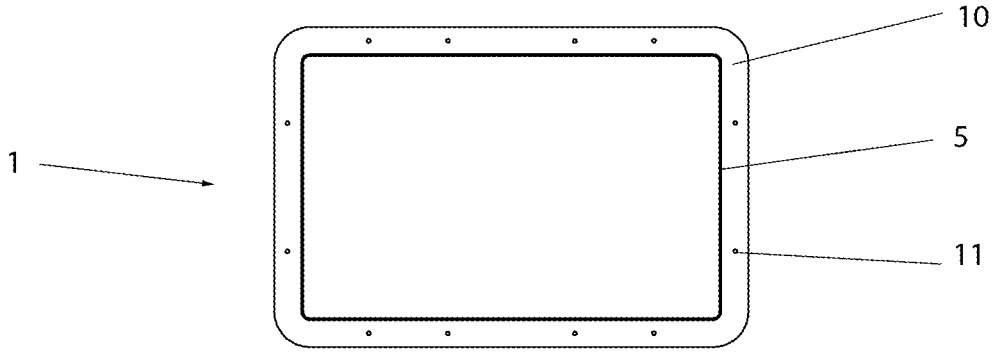
FIG. 2*b* is a plan view of the bracket shown in FIG.2*a;*
Figure 2C:
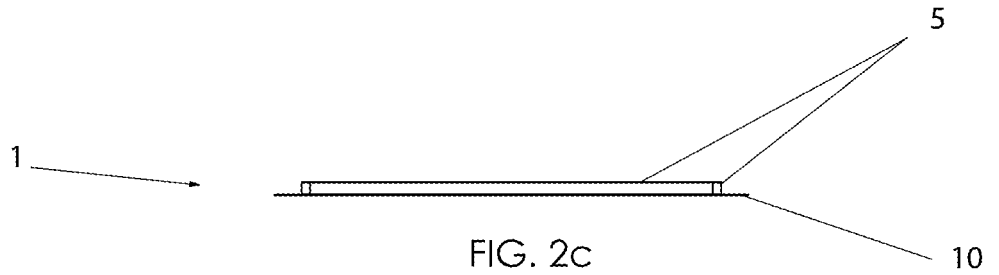
FIG. 2*c* is an elevation view of the bracket shown in FIG. 2*b;*

Horizontal base 10 and vertical flange element 5 and holes 11 for fasteners are shown in more detail in FIGS. 1*i*-*k*. In the illustrated structure, flange element 5 is discontinuous at the corners of the bracket frame for ease of construction if the bracket is formed of metal. However, the flange element 5 may be continuous about the entire periphery, as shown in FIGS. 2*a*-*c* if the bracket is injection molded plastic or the like.

As shown in FIGS. 1*d*-1*h*, the pot light support arms 3 may be hung on the flange elements 5 of bracket 1 that are perpendicular to the joists. With this orientation, pot light 2 can be moved in the perpendicular direction to adjust its position with respect to its distance from joist 4.

As shown in FIG. 1*e*, a sprung bent element 8 extends from flange 6 at the end of pot light arm 3. Flange 6 straddles vertical flange element 5 of bracket 1. Self-tapping fastener 7 is inserted through a hole in bent element 8 fixing pot light arm 3 to vertical flange element 5 of bracket 1.

Figure 3A:
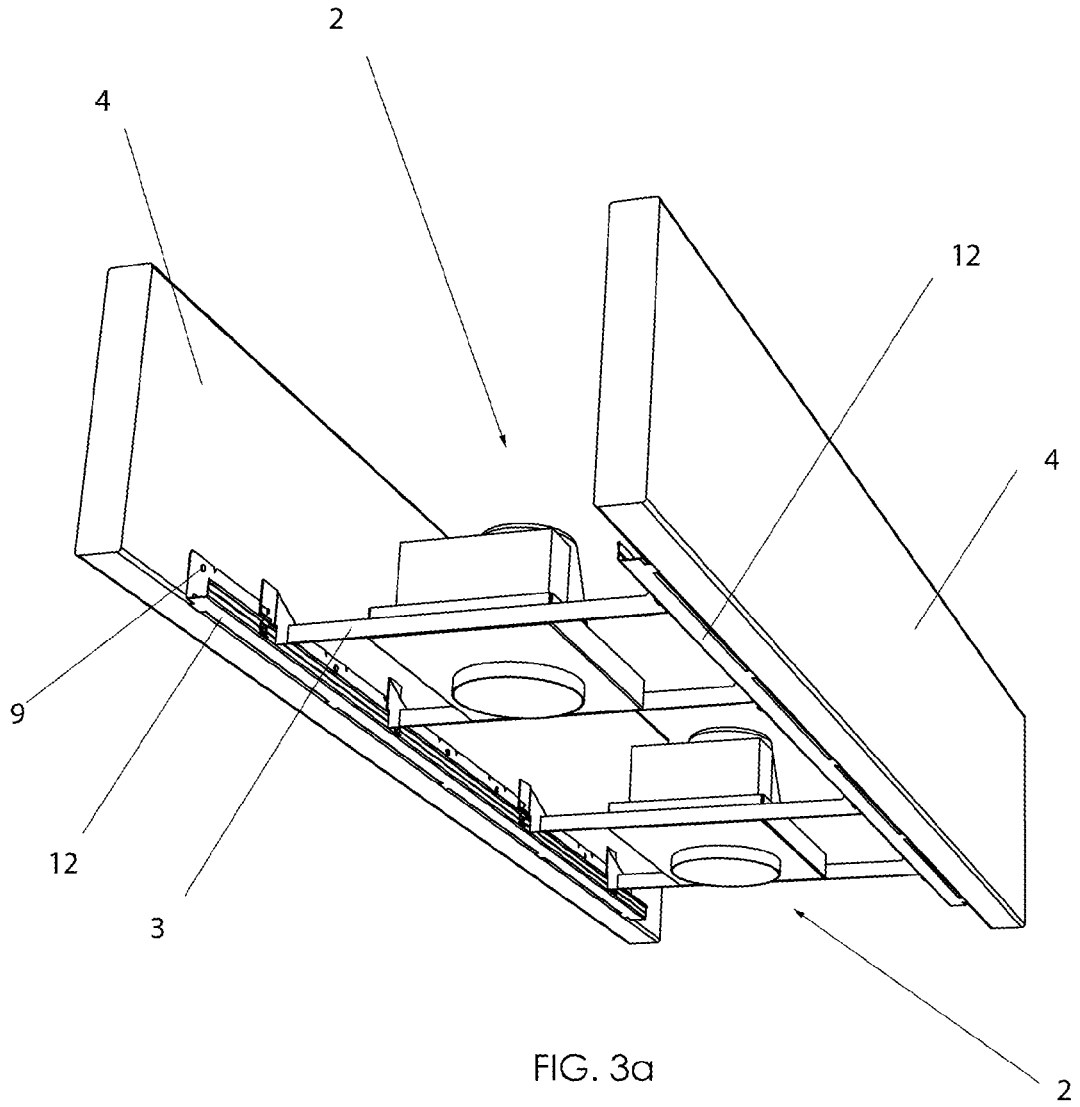
FIG. 3*a* is a perspective view from below of a preferred embodiment of joist mounted rails supporting a plurality of fixtures.
Figure 3B:
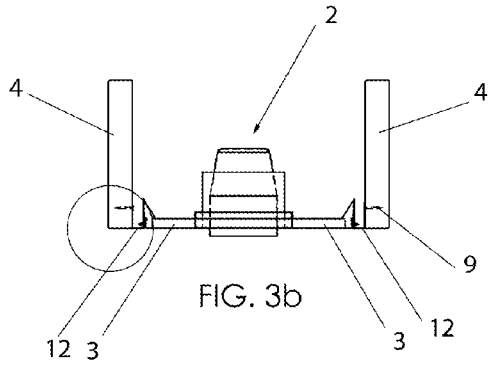
FIG. 3*b* is an elevation view of the rail installation shown in FIG. 3*a;*
Figure 3C:
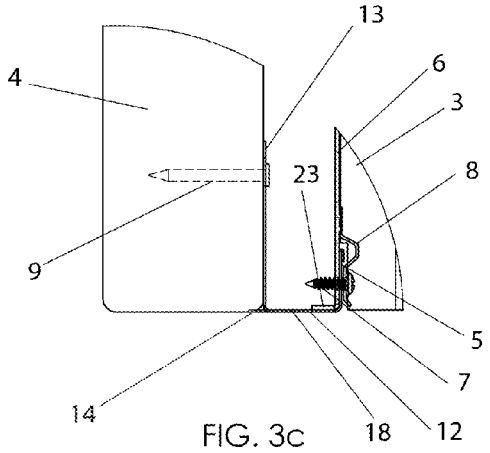
FIG. 3*c* is a detail view of a portion of FIG. 3*b;*
Figure 3D:
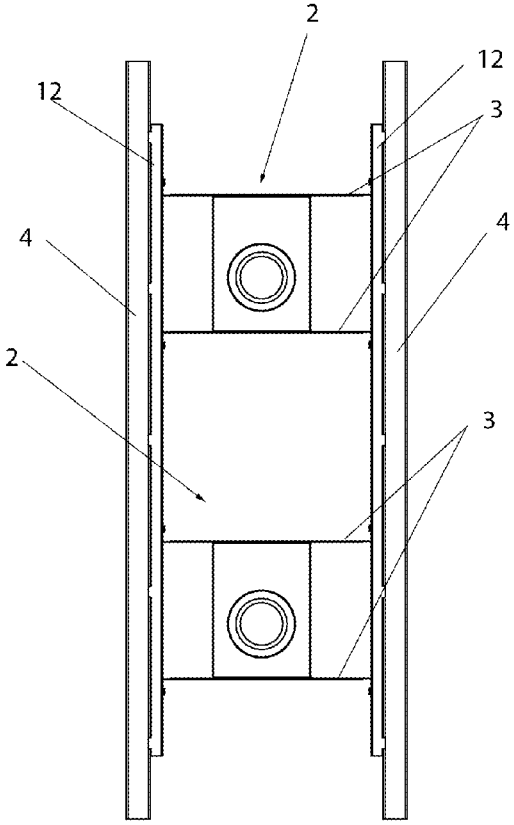
FIG. 3*d* is a bottom view of the rail installation shown in FIG. 3*b;*

A plurality of fixtures may supported by rails mounted to joists, as illustrated in FIGS. 3*a*-3*b* and 3*d*. Rails 12 are mounted facing each other on adjacent joists 4 for supporting pots lights 2 via support arms 3. Rails 12 may be mounted with fasteners 9 through vertical mounting flange 13 during rough-in stage of new construction. Pot lights 2 are hung on rails 12 and can be slid to the optimum position before being fixed in place. Rails 12 may be butted end to end to create a longer support structure for electrical devices (not shown).

As illustrated in FIG. 3*c*, pot light support arm 3 includes a sprung bent element 8 extending from flange 6. Flange 6 straddles vertical flange element 5 of rail 12, which is fastened to joist 4 with fastener 9 through vertical mounting flange 13. The foot of the pot light arm 23 rests on the top surface of horizontal element 18 of rail 12, ensuring that the pot light 2 extends appropriately below joists 4 to be substantially flush with the underside of the drywall (not shown) fastened to the underside of the joists. Tabs 14 of rail 12 extending beneath the edge of joist 4 act as positioning elements during installation to ensure that rail 12 is located flush with the underside of joist 4.

Figure 3E:
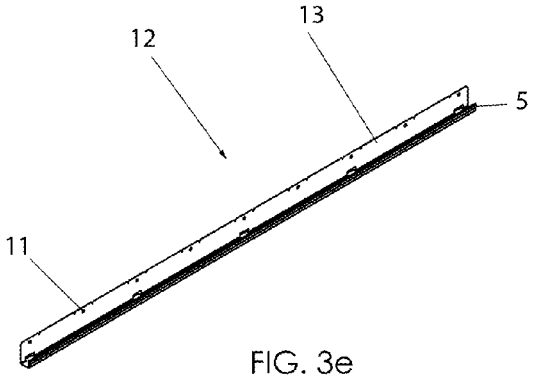
FIG. 3*e* is a perspective view of the rail installation shown in FIGS. 3*a*-3*d;*
Figure 3F:
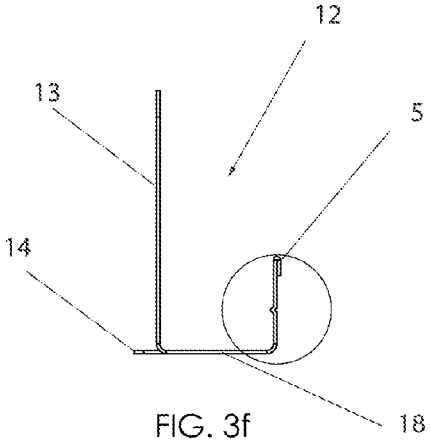
FIG. 3*f* is a side view of the rail installation shown in FIG. 3*e;*

Rail 12 is shown in more detail in FIGS. 3*e* and 3*f*. Mounting holes 11 are located on vertical mounting flange 13. The vertical flange element 5 extends from horizontal element 18 opposite the vertical mounting flange 13. Tab 14 is in line with horizontal element 18 beneath vertical mounting flange 13.

Figure 3G:
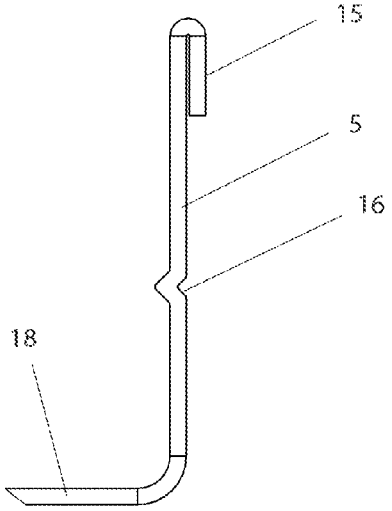
FIG. 3*g* is a detail view of a portion of FIG. 3*f;*
Figure 3H:
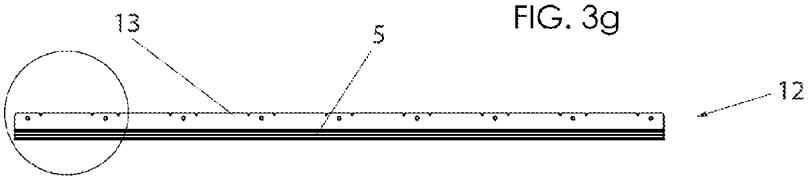
FIG. 3*h* is a front elevation of the rail installation shown in FIG. 3*e;*
Figure 3I:
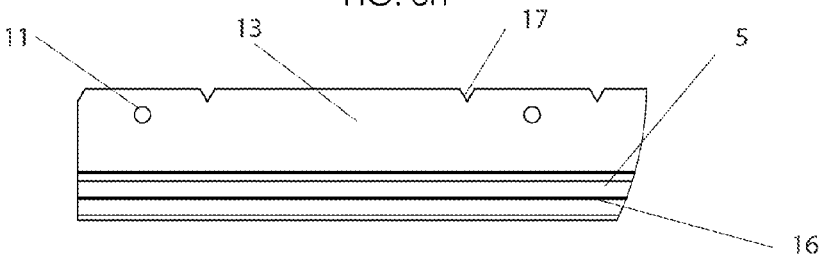
FIG. 3*i* is a detail view of a portion of FIG. 3*h;*
Figure 3J:
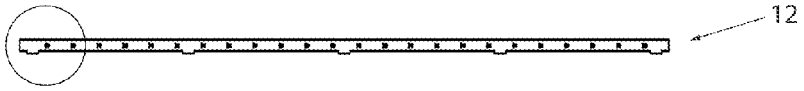
FIG. 3*j* is a bottom view of the rail shown in FIG. 3*h;*
Figure 3K:
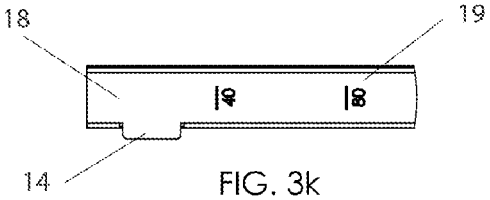
FIG. 3*k* is a detail view of a portion of FIG. 3*j;*

FIG. 3*g* is a detail view of horizontal element 18 with vertical element 5 extending therefrom. Vertical element 5 is capped with hem 15. Hem 15 removes the sharp exposed edge, provides additional strength, and provides temporary vertical retention to sprung bent element 8 shown in FIG. 3*c*. Linear recess 16 on vertical elements 5 facilitates initial penetration and threading of self-tapping fastener 7 shown in FIG. 3*c*. FIG. 3*h* shows rail 12 with vertical flange element 5 and vertical mounting flange 13. In FIG. 3*i*, vertical flange element 5 is shown with linear recess 16. Vertical mounting flange 13 is shown with mounting holes 11 and scores 17 to facilitate cutting with shears or the like at intervals on either side of mounting holes 11. Rail 12 with horizontal element 18 and tabs 14 are depicted in FIGS. 3*j* and 3*k*. Printed or debossed length markings 19 on the underside of horizontal element 18, coinciding with score marks 17, illustrated in FIG. 3*i*, facilitate cutting to length without need for measurement with a tape measure or the like. These dimension gradients can also be used to facilitate pot light spacing.

Figure 4A:
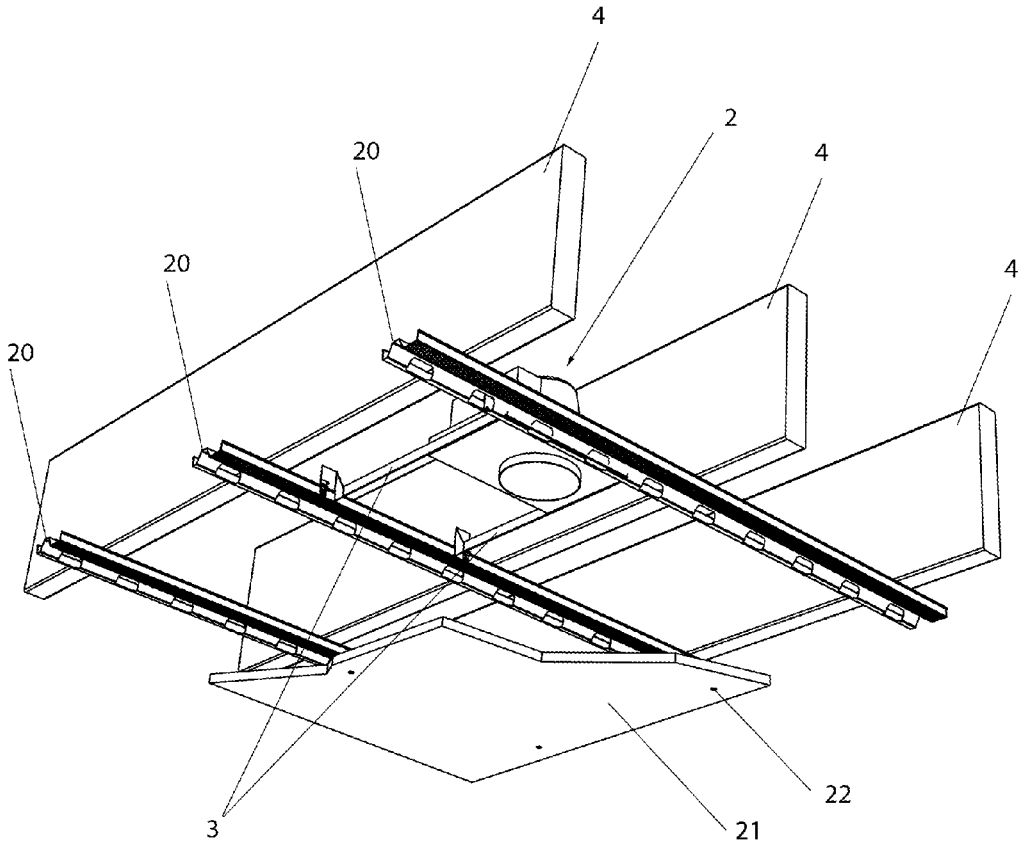
FIG. 4*a* is a perspective view from below of a resilient channel installation.
Figure 4B:
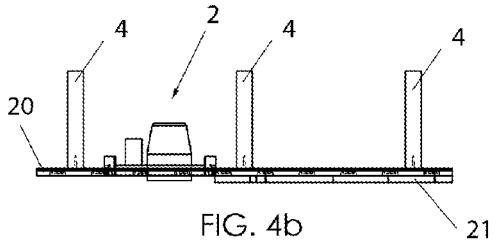
FIG. 4*b* is a front elevation of the channel installation shown in FIG. 4*a;*
Figure 4C:
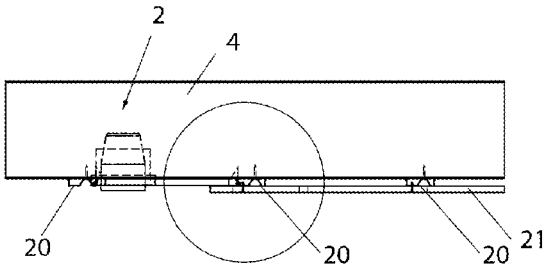
FIG. 4*c* is a side elevation of the channel installation shown in FIG. 4*b;*
Figure 4D:
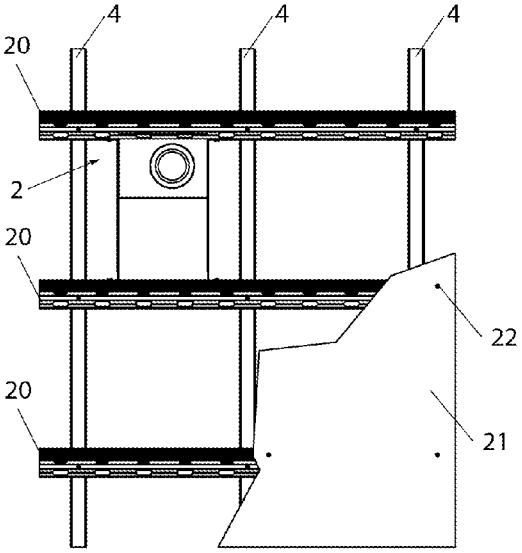
FIG. 4*d* is a bottom view of the channel installation shown in FIG. 4*b;*
Figure 4E:
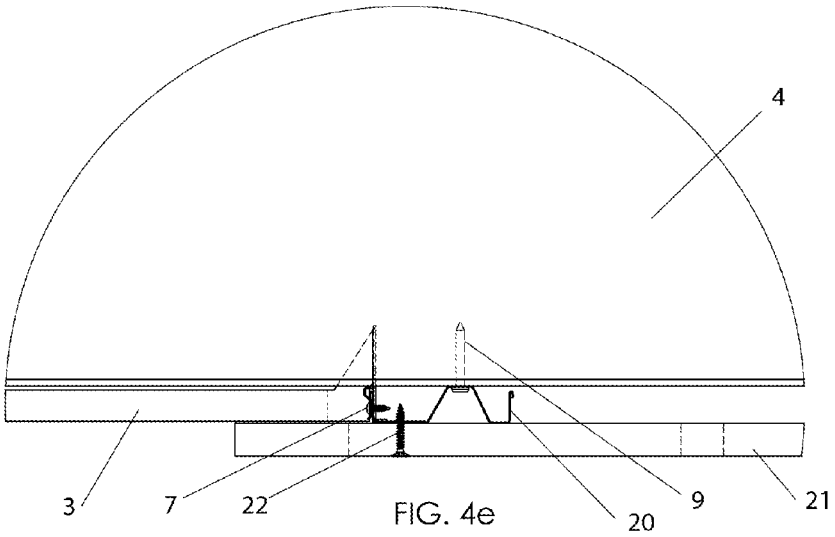
FIG. 4*e* is a detail view of a portion of FIG. 4*c;*

Referring to the resilient channel installation illustrated in FIGS. 4*a*-4*d*, ceiling joists 4 support resilient channels 20, which in turn support pot light 2 via support arms 3 and drywall 21 via fasteners 22. Resilient channels 20 provide for a more flat installation of drywall 21 by flexing to account for out variations in distance from the undersides of joists 4. Resilient channels 20 also dissipate sound wave transmission between floors. By nature of the flexibility of resilient channel 20, the drywall is structurally decoupled from joists 4, thereby transmitting substantially less vibration and sound energy. Joist 4 supports resilient channel 20 with fastener 9, as illustrated in FIG. 4*e*. One pot light support arm 3 is supported by resilient channel 20 and fixed in place with fastener 7. Drywall 21 is screwed to resilient channel 20 with fastener 22.

Figure 4F:
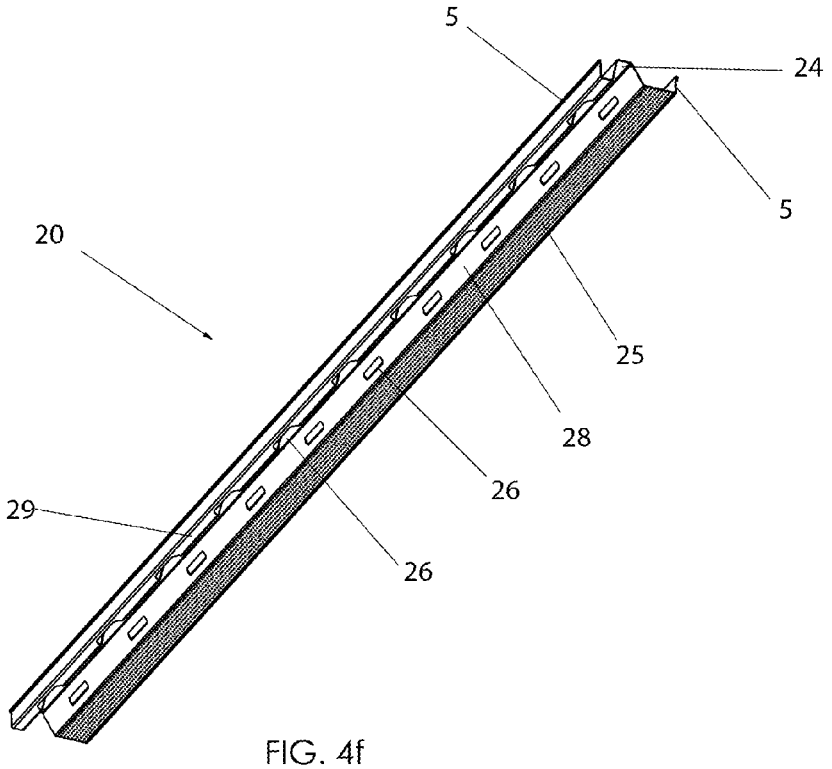
FIG. 4*f* is a perspective view from below of the channel shown in FIGS. 4*a*-4*e;*
Figure 4G:
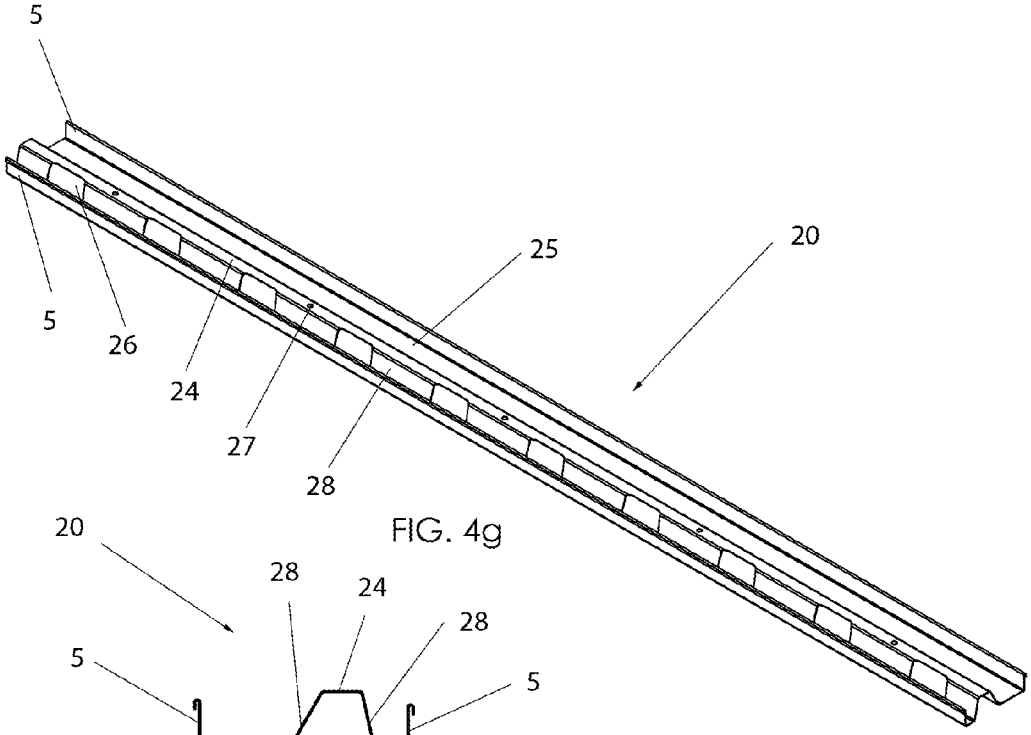
FIG. 4*g* is a perspective view from above of the channel shown in FIGS. 4*a*-4*e;*
Figure 4H:
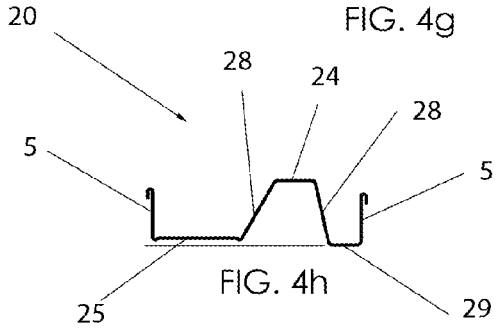
FIG. 4*h* is an end view of the channel shown in FIGS. 4*f*-4*g;*

Resilient channel 20 may include angled elements 28 and cut away holes 26 to facilitate flexion, as illustrated in FIG. 4*f*. Vertical elements 5 extend from either side of resilient channel 20, allowing pot light support on both sides. Horizontal drywall mounting surface 25 comprises debossed dimples that facilitate initial penetration and threading of self tapping fastener 22, as shown in FIG. 4*f*. Channel mounting holes 27 are located on the upper horizontal mounting surface 24. Vertical elements 5 and angled elements 28 are illustrated in the sectional view of FIG. 4*h*. Narrow horizontal pot light support element 29 extends below the drywall mounting surface 25 so that after installation of the drywall narrow horizontal pot light support element 29 is forced upwards and is flush with drywall mounting surface 25, ensuring that the pot light is installed parallel to the drywall.

Figure 5A:
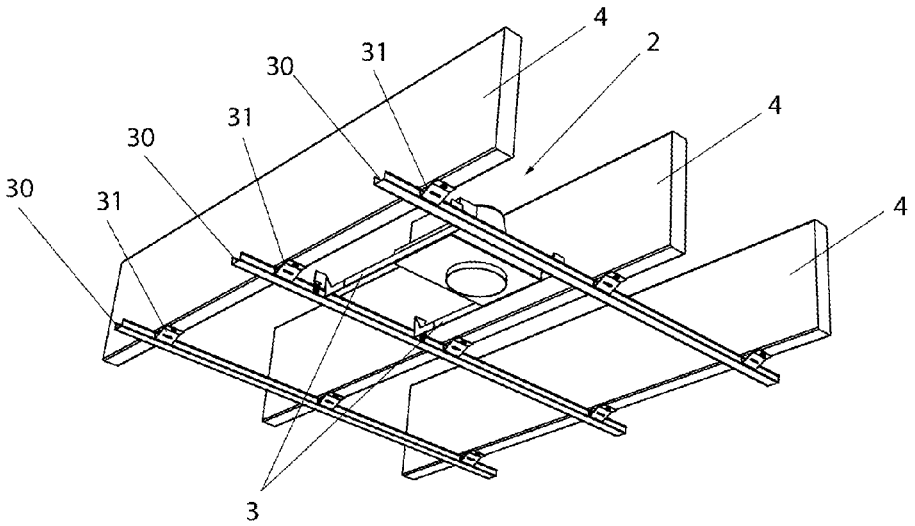
FIG. 5*a* is a perspective view from below of another channel installation.
Figure 5B:
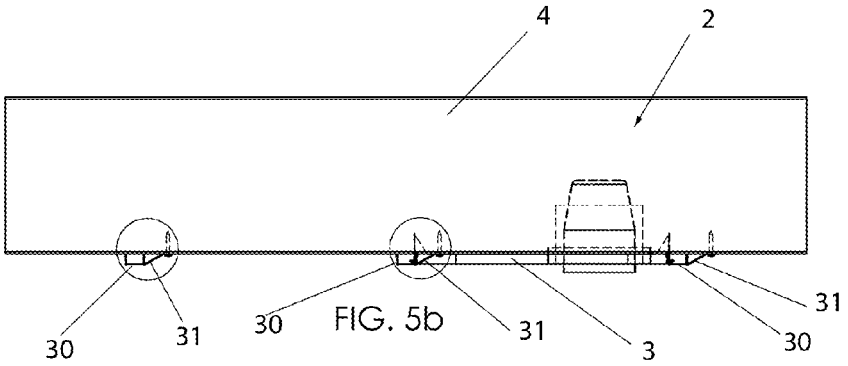
FIG. 5*b* is a side elevation of the channel installation shown in FIG. 5*a;*
Figure 5C:
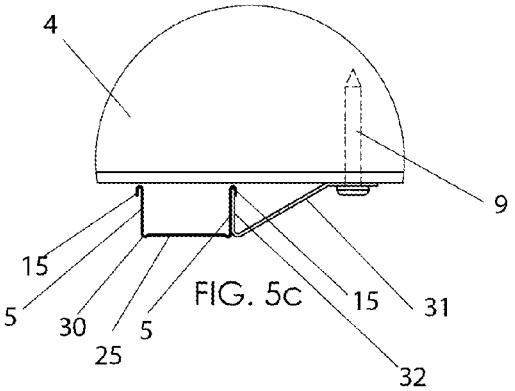
FIG. 5*c* is a detail view of a left portion of FIG. 5*b;*
Figure 5D:
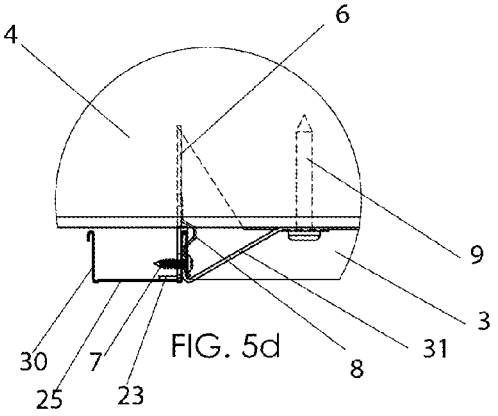
FIG. 5*d* is a detail view of a middle portion of FIG. 5*c;*
Figure 5E:
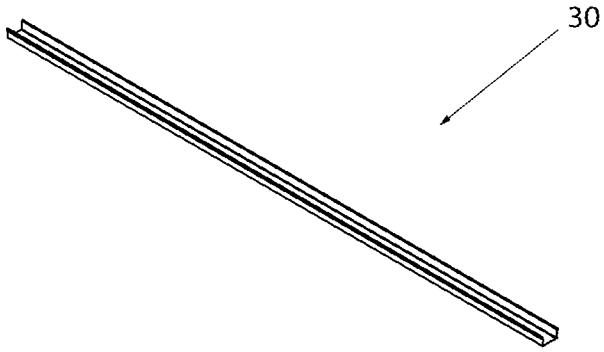
FIG. 5*e* is a perspective view from above of the channel shown in FIGS. 5*a*-5*d;*
Figure 5F:
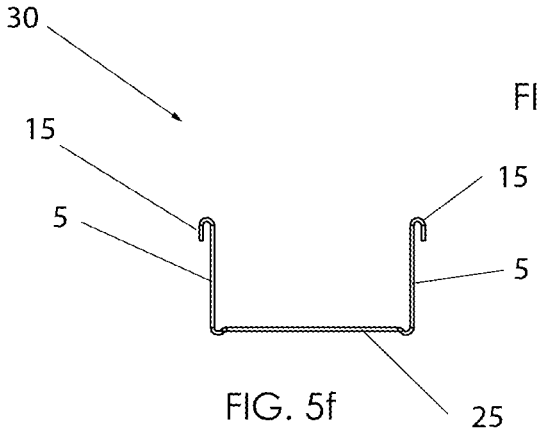
FIG. 5*f* is an end view of the channel shown in FIG. 5*e;*
Figure 5G:
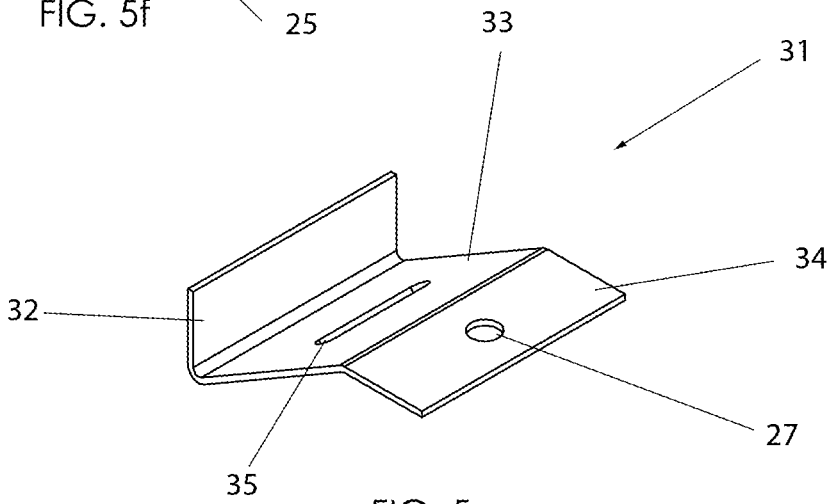
FIG. 5*g* is a perspective view from above of the hanger shown in FIGS. 5*a*-5*d;*
Figure 5H:
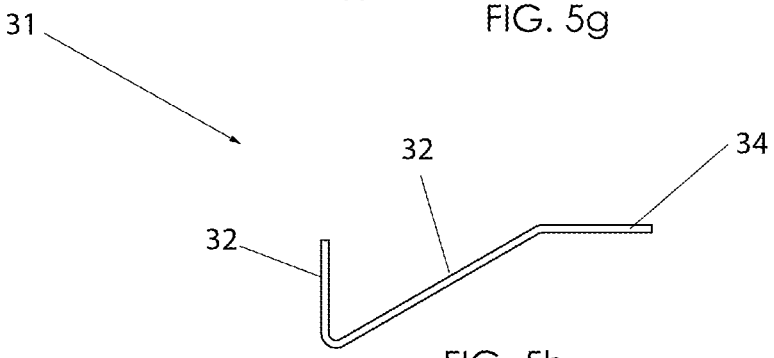
FIG. 5*h* is an end view of the hanger shown in FIG. 5*g;*

An alternative channel assembly is illustrated in FIGS. 5*a*-*d*. Channel 30 has a U shaped cross-section with hems 15 at the top of vertical elements 5. Hangers 31 are screwed into joists 4 with fasteners 9. Vertical element 32 of hanger 31 hooks under hem 15 and supports channel 30. Drywall (not shown), or other ceiling substrate, may be screwed to the underside of channel 30 through substrate mounting surface 25. Pot light 2, via support arms 3, fits over channel vertical element 5. Pot light sprung bent element 8 temporary retains the position until fastener 7 is screwed through the sprung bent element 8 and the vertical element 5 of channel 30 to retain it permanently. Pot light support arm foot 23 rests on the inside bottom of channel 30. Hanger 31, due to its geometry, allows the channel 30 to flex down and provide a more flat drywall installation and reduce the amount of sound transmission that passes through the structure. Vertical elements 5, hems 15 and drywall support surface 25 are depicted in more detail in FIGS. 5*e*-5*f*. FIGS. 5*g*-5*h* depict hanger 31 with mounting surface 34 and mounting hole 27. Vertical element 32, along with angled element 33 and cut away area 35, facilitate flexion.

Figure 6A:
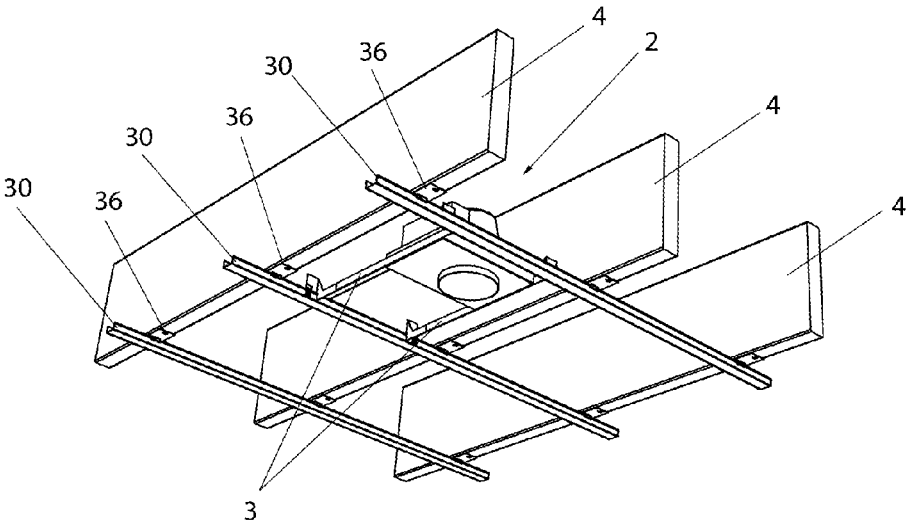
FIG. 6*a* is a perspective view from below of another channel installation.
Figure 6B:
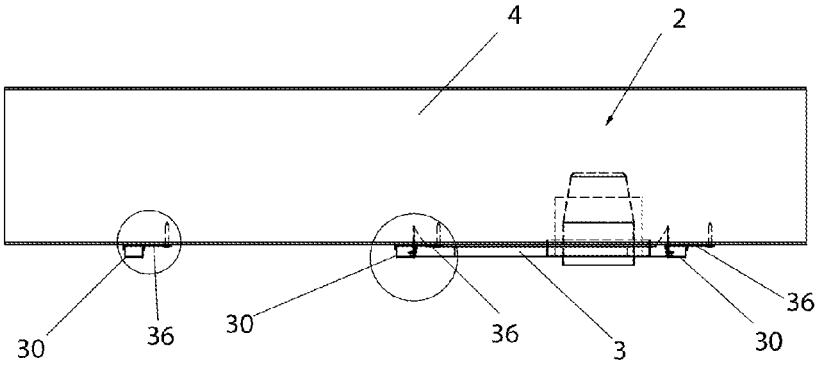
FIG. 6*b* is a side elevation of the channel installation shown in FIG. 6*a;*
Figure 6C:
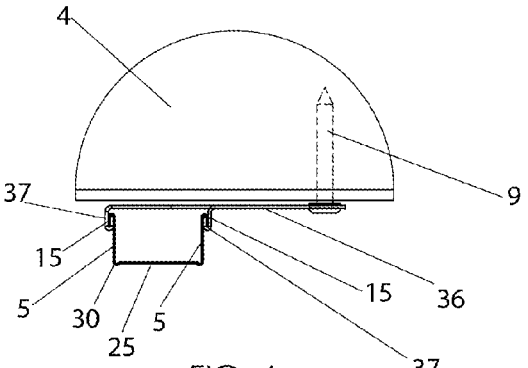
FIG. 6*c* is a detail view of a left portion of FIG. 6*b;*
Figure 6D:
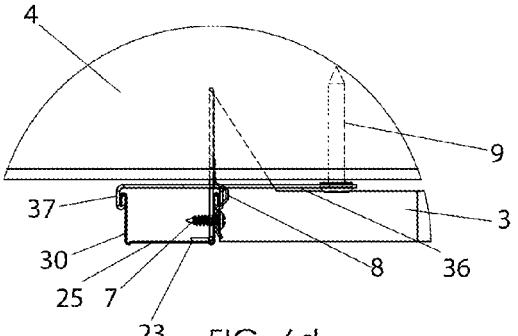
FIG. 6*d* is a detail view of a middle portion of FIG. 6*c;*
Figure 6E:
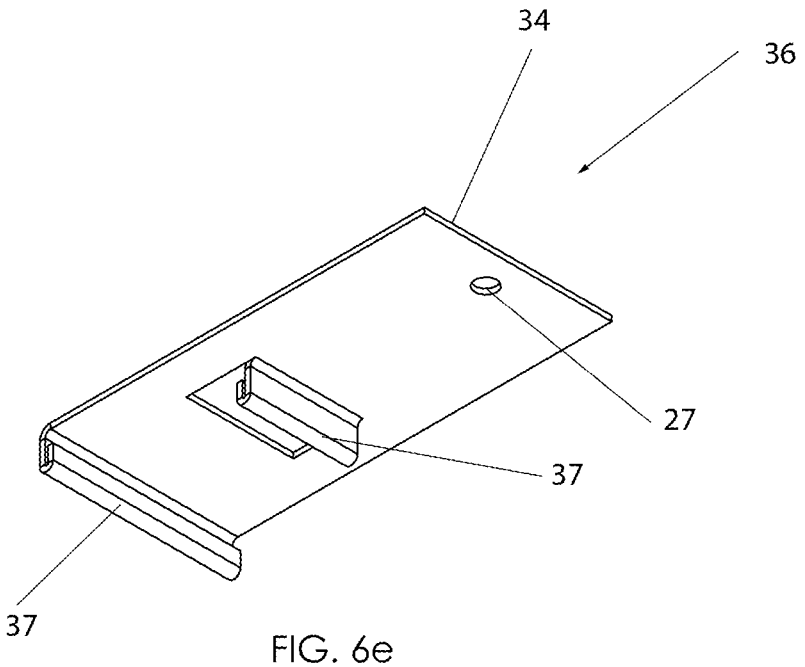
FIG. 6*e* is a perspective view from below of the hanger shown in FIGS. 6*a*-6*d;*
Figure 6F:
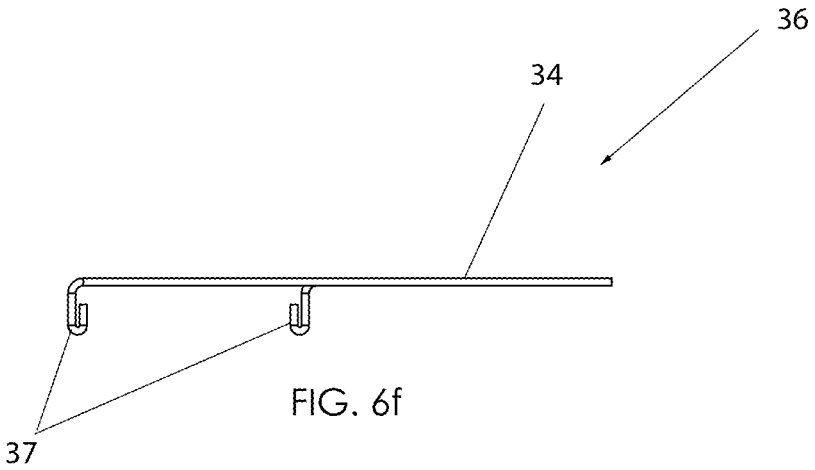
FIG. 6*f* is an end view of the hanger shown in FIG. 6*e;*
Figure 7A:
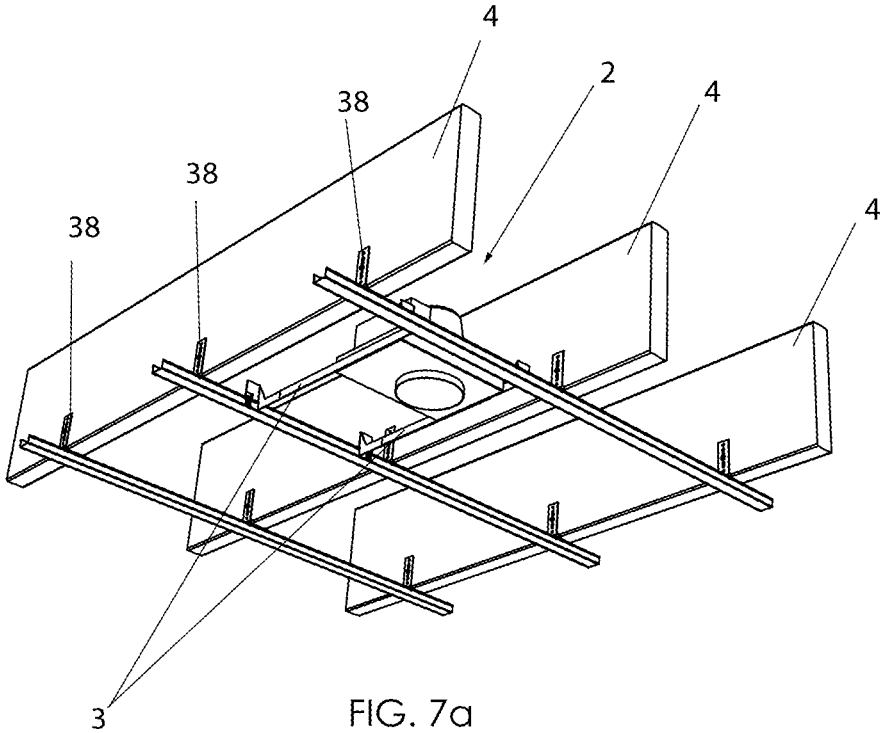
FIG. 7*a* is a perspective view from below of another channel installation.
Figure 7B:
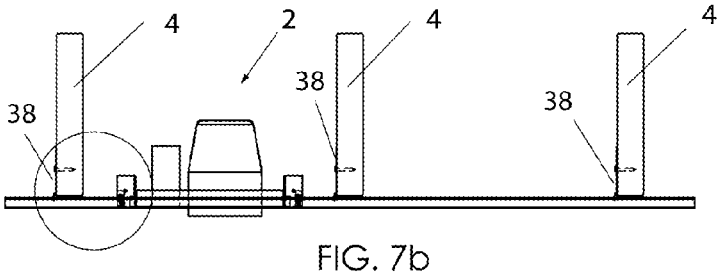
FIG. 7*b* is a front elevation of the channel installation shown in FIG. 7*a;*
Figure 7C:
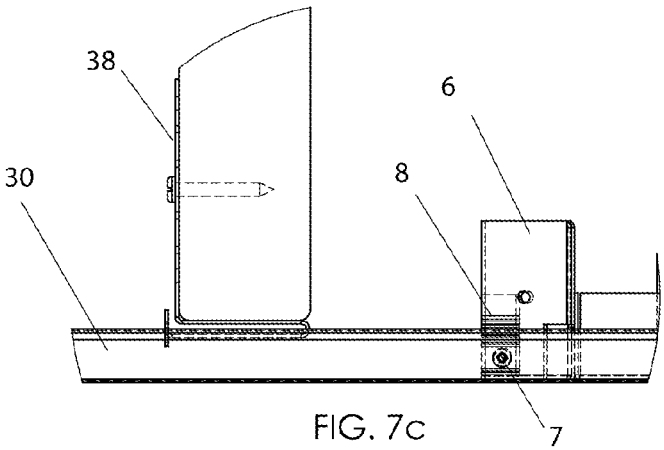
FIG. 7*c* is a detail view of the portion of FIG. 7*b;*
Figure 7D:
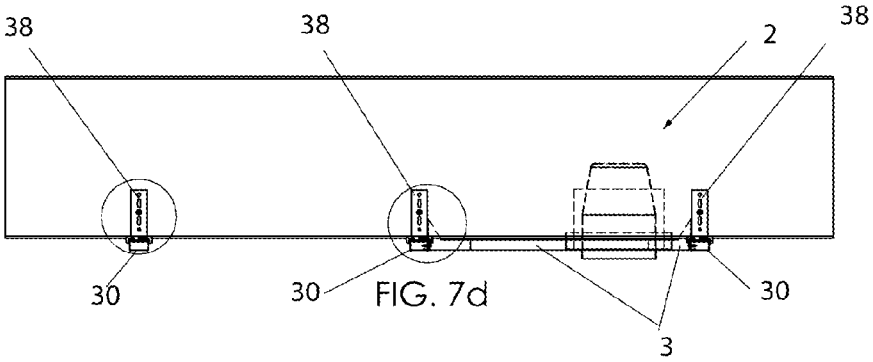
FIG. 7*d* is a side elevation of the channel installation shown in FIG. 7*a;*
Figure 7E:
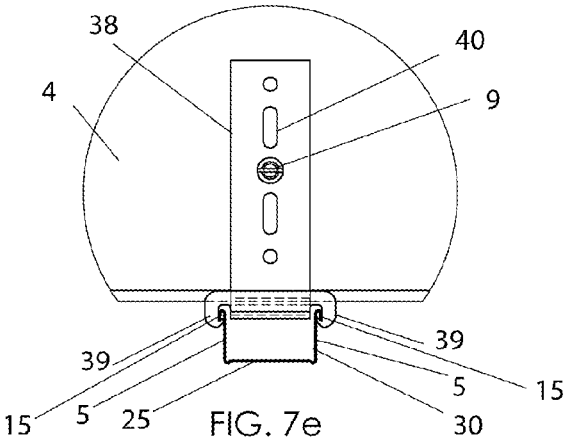
FIG. 7*e* is a detail view of a left portion of FIG. 7*d;*
Figure 7F:
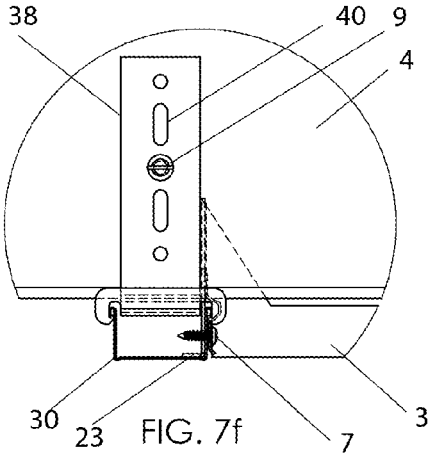
FIG. 7*f* is a detail view of a middle portion of FIG. 7*d;*
Figure 7G:
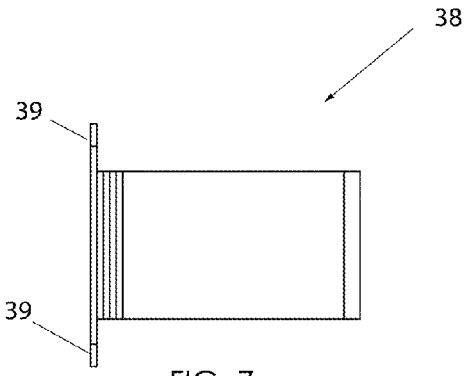
FIG. 7*g* is a top view of the hanger shown in FIGS. 7*a*-7*f;*
Figure 7H:
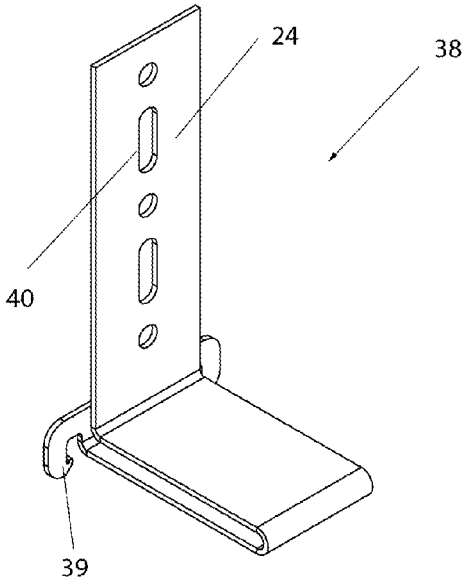
FIG. 7*h* is a perspective view of the hanger shown in FIG. 7*g;*
Figure 7I:
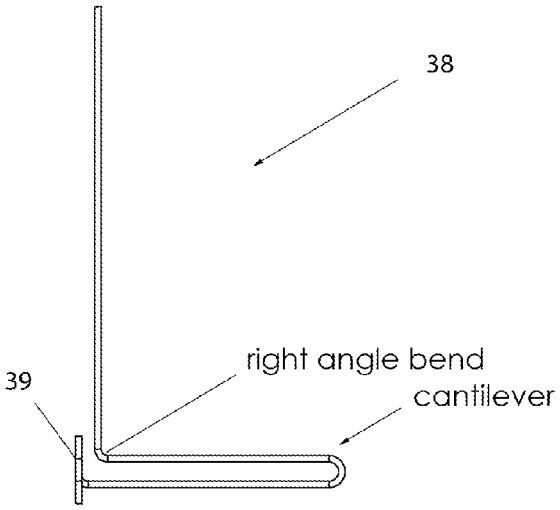
FIG. 7*i* is a side view of the hanger shown in FIG. 7*g;*
Figure 7J:
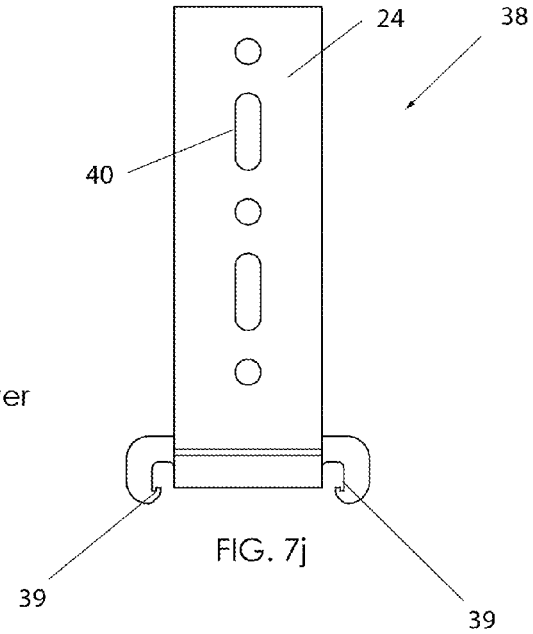
FIG. 7*j* is a side view of the hanger shown in FIG. 7*i;*
Figure 8A:
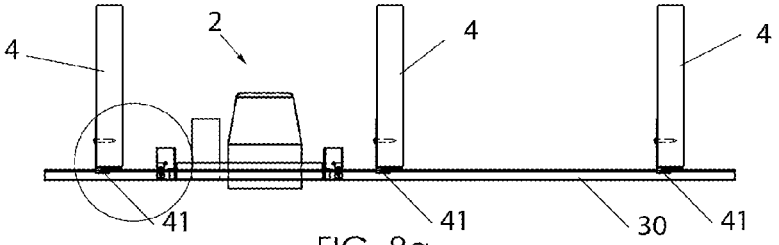
FIG. 8*a* is a front elevation of another channel installation.
Figure 8B:
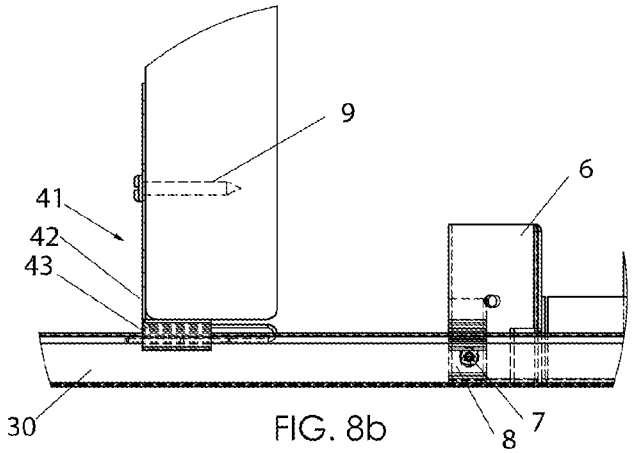
FIG. 8*b* is a detail view of a portion of FIG. 8*a;*
Figure 8C:
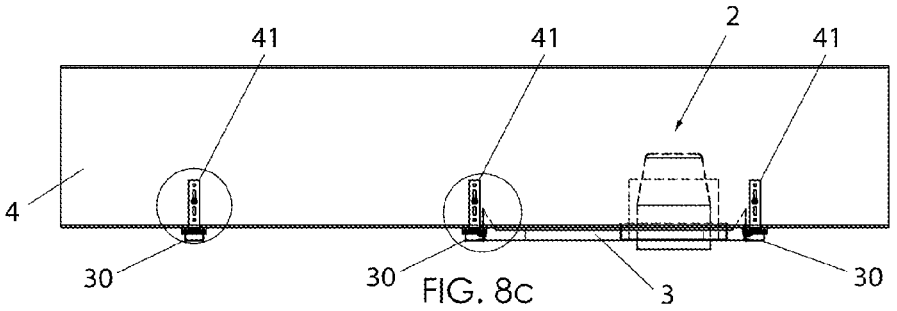
FIG. 8*c* is a side elevation of the channel installation shown in FIG. 8*a;*
Figure 8D:
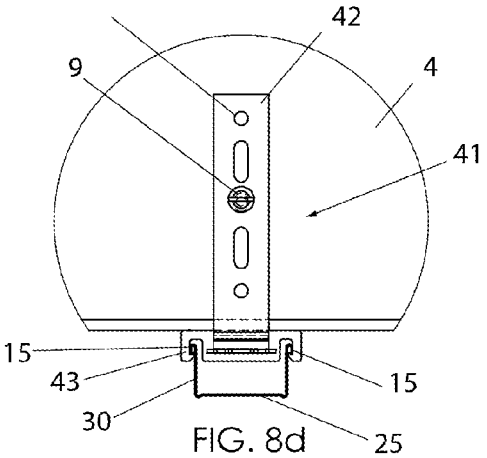
FIG. 8*d* is a detail view of a left portion of FIG. 8*c;*
Figure 8E:
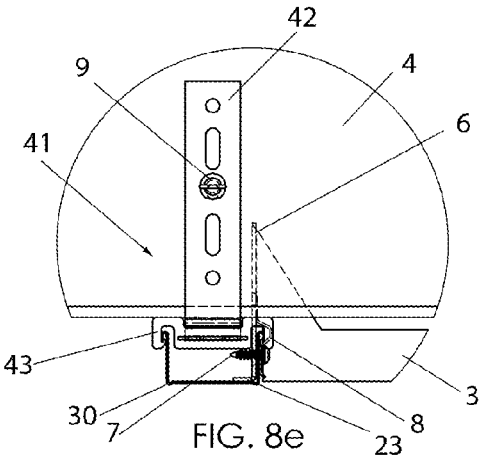
FIG. 8*e* is a detail view of a middle portion of FIG. 8*c;*
Figure 8F:
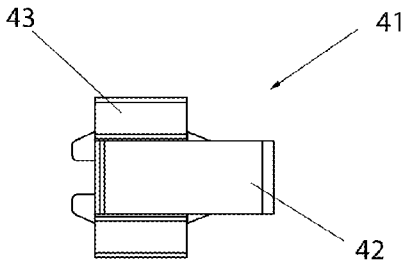
FIG. 8*f* is a top view of the hanger assembly shown in FIGS. 8*a*-8*e;*
Figure 8G:
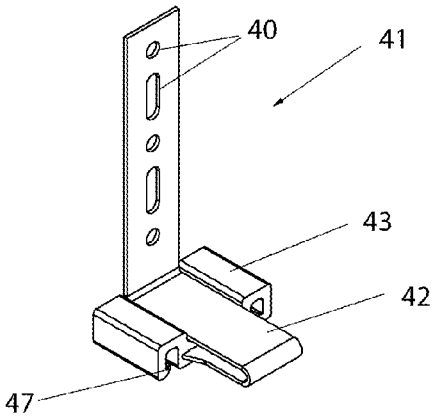
FIG. 8*g* is a perspective view of the hanger assembly shown in FIG. 8*f;*
Figure 8H:
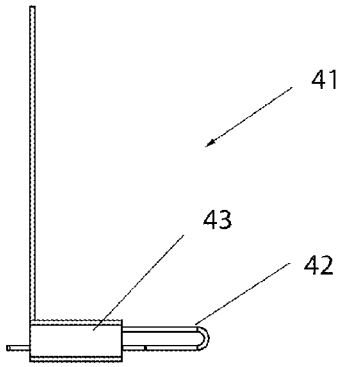
FIG. 8*h* is a side view of the hanger assembly shown in FIG. 8*f;*
Figure 8I:
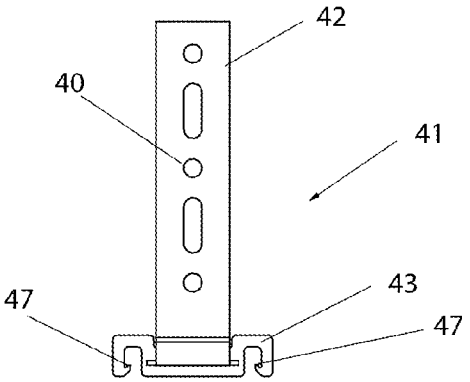
FIG. 8*i* is a side view of the hanger assembly shown in FIG. 8*h;*
Figure 8J:
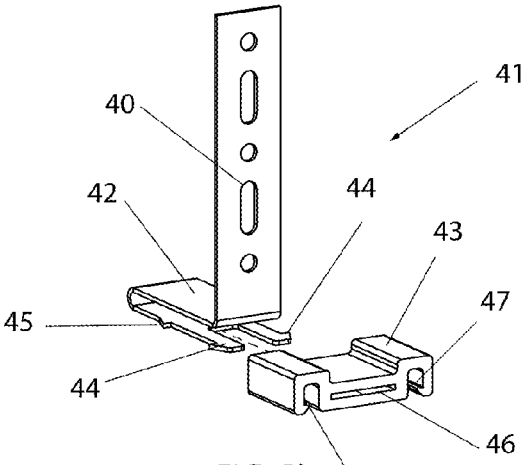
FIG. 8*j* is an exploded perspective view of the hanger assembly shown in FIGS. 8*f*-8*i;*
Figure 8K:
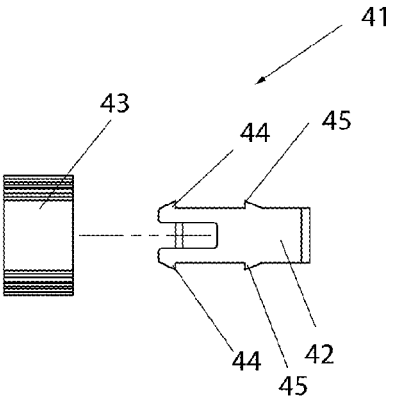
FIG. 8*k* is a bottom view of the exploded hanger assembly shown in FIG. 8*j;*
Figure 9A:
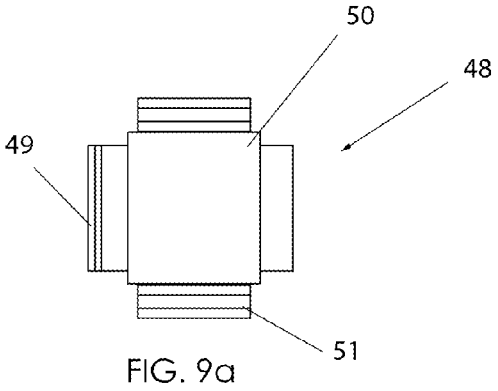
FIG. 9*a* is a top view of an alternative hanger assembly embodiment.
Figure 9B:
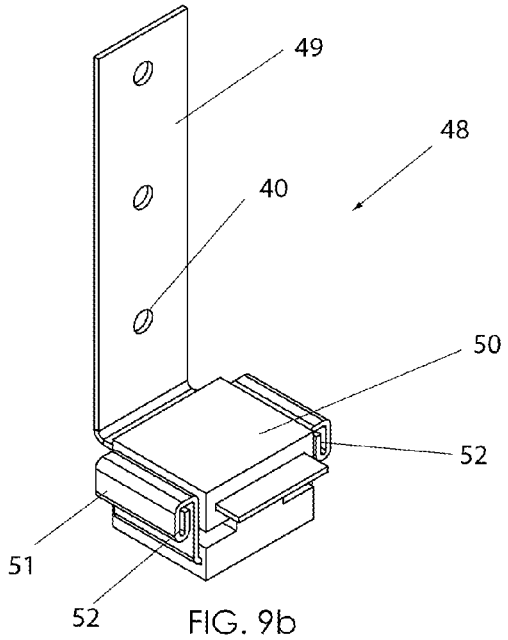
FIG. 9*b* is a perspective view of the hanger assembly shown in FIG. 9*a;*
Figure 9C:
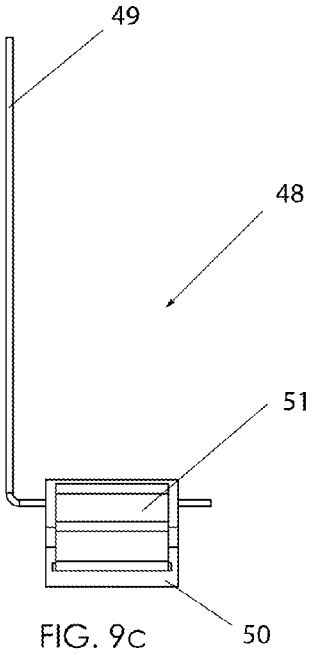
FIG. 9*c* is a side view of the hanger assembly shown in FIG. 9*a;*
Figure 9D:
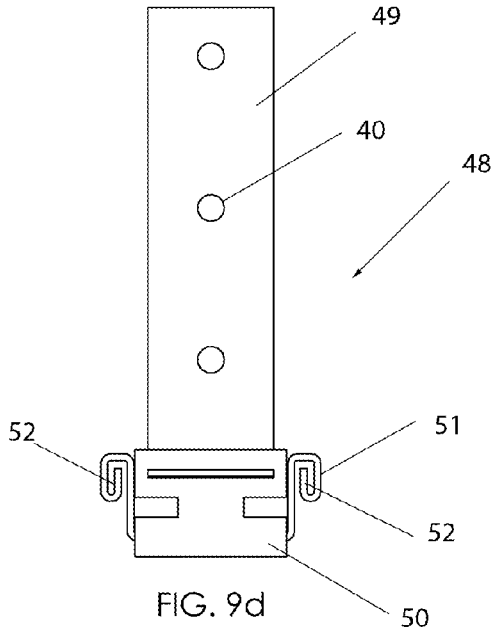
FIG. 9*d* is a side view of the hanger assembly shown in FIG. 9*c;*
Figure 10A:
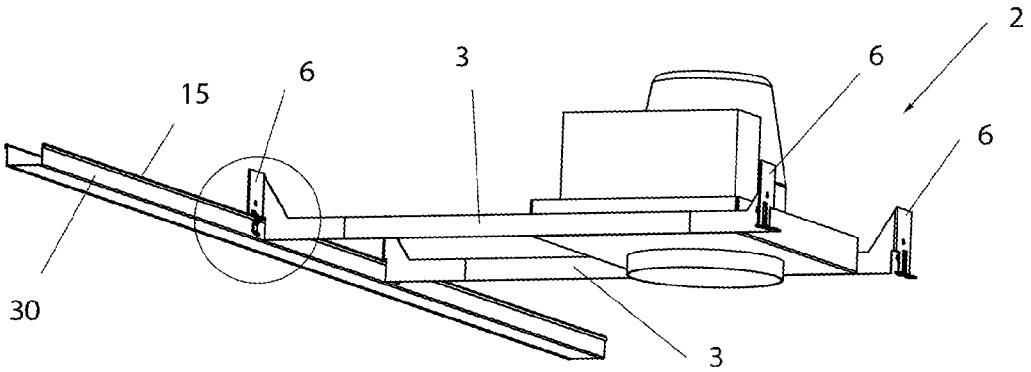
FIG. 10*a* is a perspective partial view from below of a support channel with a barbed sprung retainer.
Figure 10B:
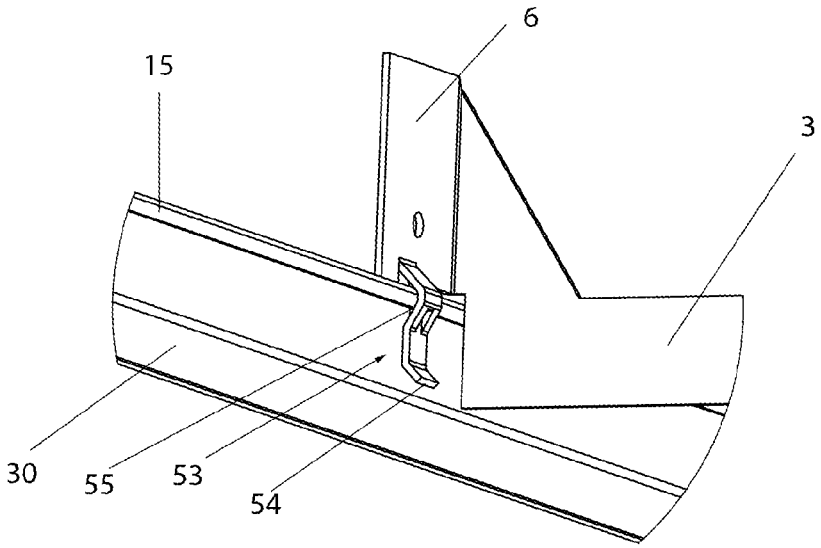
FIG. 10*b* is a detail view of a portion of FIG. 10*a;*
Figure 10C:
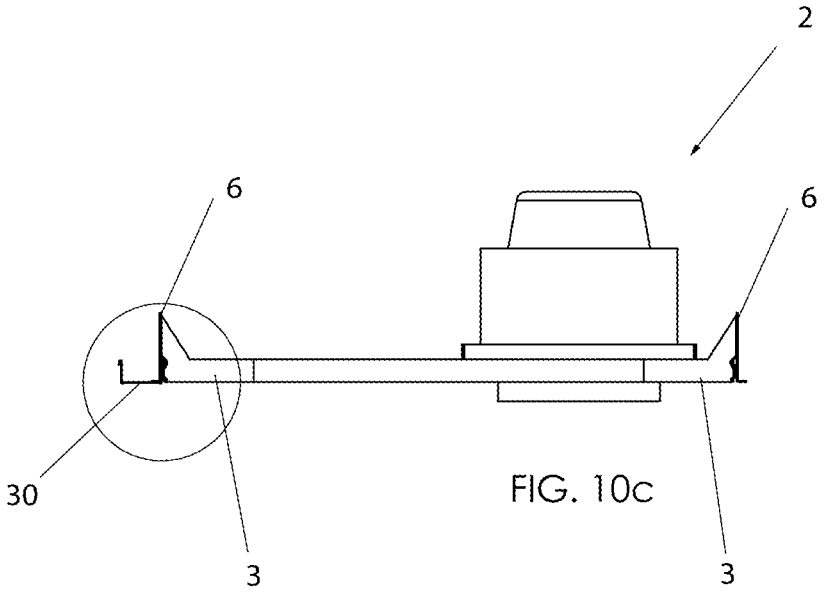
FIG. 10*c* is a side view of the installation shown in FIG. 10*a;*
Figure 10D:
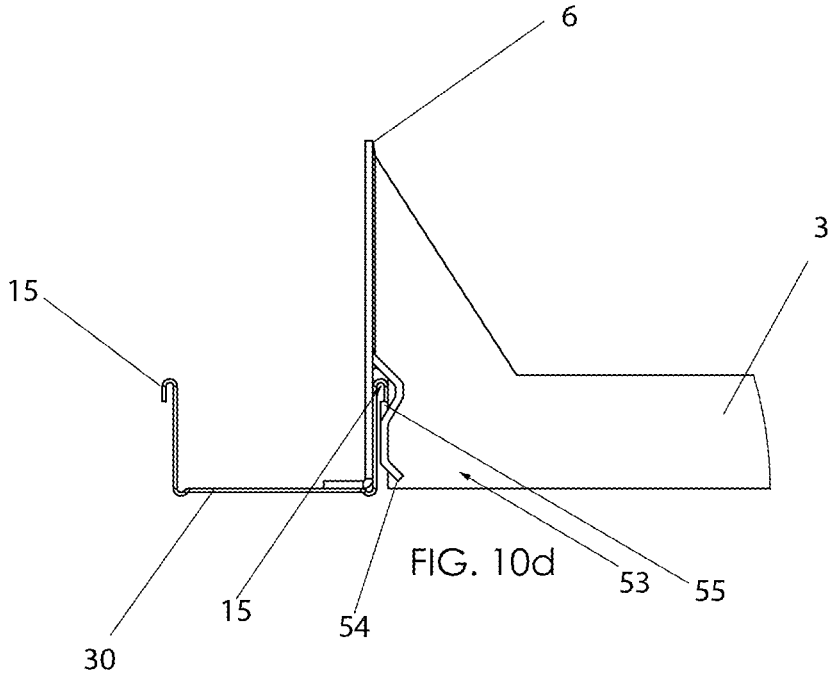
FIG. 10*d* is a detail view of a portion of FIG. 10*c;*
Figure 10E:
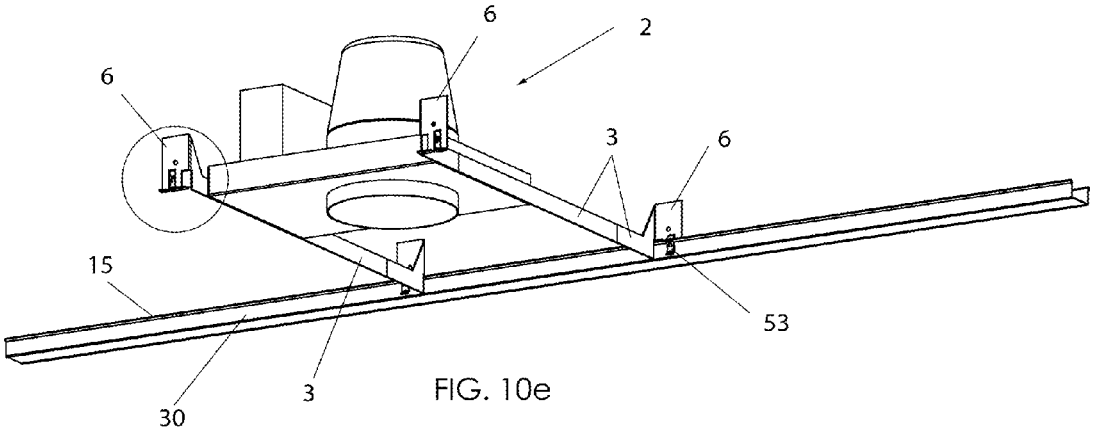
FIG. 10*e* is a perspective view from below and behind of the installation shown in FIG. 10*a;*
Figure 10F:
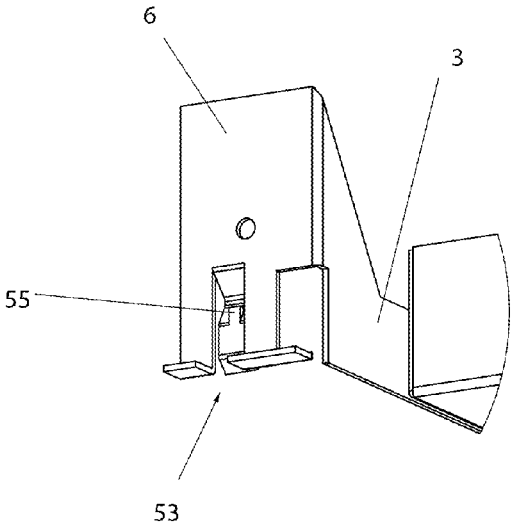
FIG. 10*f* is a detail view of a portion of FIG. 10*e;*

Another alternative installation assembly is illustrated in FIGS. 6*a*-6*d*. Resilient hangers 36 are screwed into joists 4 with fasteners 9. Hemmed retainers 37 of hanger 36, hooked under hems 15, support channel 30. Drywall (not shown), or other ceiling substrate, screws to the underside of channel 30 through drywall mounting surface 25. Pot light 2, via support arms 3, fits over channel vertical element 5. Pot light sprung bent element 8 temporary retains position until fastener 7 is screwed through the sprung bent element 8 and the vertical element 5 of channel 30 to retain it permanently. Pot light support arm foot 23 rests on the inside bottom of channel 30. Hanger 36, due to its geometry, allows channel 30 to flex down and provide a more flat drywall installation and reduce the amount of sound transmission that passes through the structure. Channel 30 can be slid into hanger 36 from the end. Alternatively, it can be snapped into the hemmed retainers 37 by flexing the vertical elements 5 of channel 30 toward each other, pushing it beyond the hemmed retainer 37, and releasing the flexed vertical elements 5, allowing them to drop into hemmed retainers 37. FIGS. 6*e*-6*f* depict hanger 36 with mounting surface 34, mounting hole 27, and hemmed retainers 37. The distance between the hemmed retainers 37 and the mounting hole 27 allows the hanger to flex when the channel is loaded with drywall.

Another alternative installation is illustrated in FIGS. 7*a*-7*f*. Resilient hangers 38 are screwed into joists 4 with fasteners 9 through mounting holes 40. The bent sheet metal hanger hooks 39 are hooked beneath hems 15 of support channel 30. A one hundred eighty degree bend in the hanger characterizes a u-shaped cantilever. The geometry of hanger 38 allows it to flex when channel 30 is loaded with drywall, thereby producing a flatter installation with consequent reduction in sound transmission through the structure. Hanger 38, hooks 39, and mounting holes 40 on mounting surface 24, are shown in detail in FIGS. 7*g*-7*j*. A variation of this installation is illustrated in FIGS. 8*a*-8*k*.

In FIGS. 8*a*-8*e*, hanger assemblies 41 are screwed into joists 4 with fasteners 9 through mounting holes 40. The bent sheet metal hanger base 42 and elastomeric retainer 43 retain the hems 15 of channel 30. The cantilever geometry of hanger 38 allows it to flex when channel 30 is loaded with drywall, thereby producing a flatter installation with consequent reduction in sound transmission through the structure. The elastomeric retainer 44 serves as an isolator further reducing the sound transmission through the structure. Pot light 3 is supported by channel 30 via support arms 3. Support arm feet 23 rests on the inside bottom of channel 30. Fastener 7 passes through sprung bent element 8, which extends from flange 6, and threads into channel 30. FIGS. 8*f*-8*k* illustrate hanger assembly 41 in further detail. Hanger base 42 includes mounting holes 40, barbed retainers 44, and stops 45 that retain the elastomeric retainer 43 via slot 46. The elastomeric retainer 43 includes hooks 47 on either side that retain hems 15 of channel 30, as can be seen in FIGS. 8*a*-8*e*.

A further variation of flexible hanger assembly is depicted in FIGS. 9*a*-9*e*. Hanger assembly 48 includes hanger base 49, isolator 50 and retainer 51. The hanger assembly 48 may be fastened to a joist (not shown) through mounting holes 40. Isolator 50 is made of an elastomeric material held proximate its top by hanger base 49. Isolator 50 supports, proximate its bottom, retainer 51. Retainer 51 includes retainer hems 52, which support hems 15 of channel 30.

FIGS. 10*a*-10*f* exemplify an interface arrangement between support arms 3 of pot light 2 and channel 30. The hanger and joist and the second channel required to support the pot light are not visible. Flange 6, which extends from support arm 3, is formed with a sprung barbed retainer 53 with an upturned leading edge 54 that allows it to extend over hem 15 of channel 30 during installation. Barb 55 locks under hem 15 of channel 30 to secure the support arm 3 and pot light 2 into position without fasteners. Alternative interface arrangements are depicted in FIGS. 11*a*-13*a*.

Figure 11A:
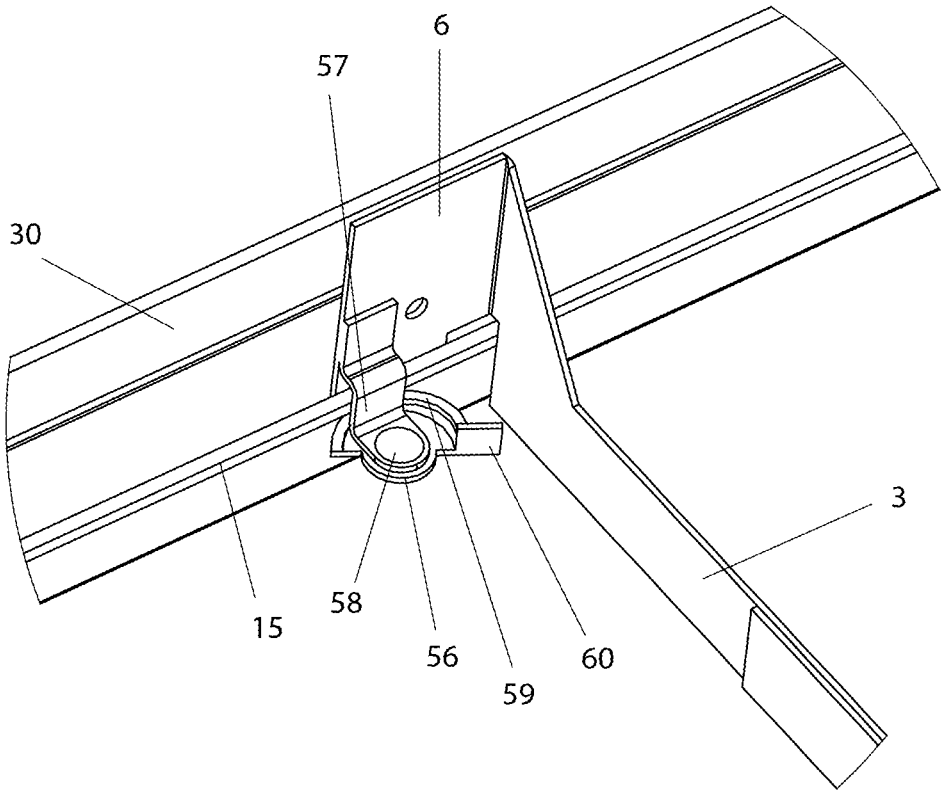
FIG. 11*a* is a perspective view from above of a support arm with a ramped locking device on a channel.

In FIG. 11*a*, wedge element 56 is fastened via rivet 58 to tab 57 that extends from flange 6. Wedge element 56 is free to rotate about the center of rivet 58. Pot light support arm 3 is hung on hem 15 of channel 30 with wedge element 56 positioned to clear the channel. Once the pot light is positioned, wedge element 56 is rotated until inclined surface 59 rides beneath hem 15 to secure support arm 3 to channel 30. Wedge actuator 60 provides a surface upon which to push and pull with fingers to lock and unlock the wedge element 56.

Figure 12A:
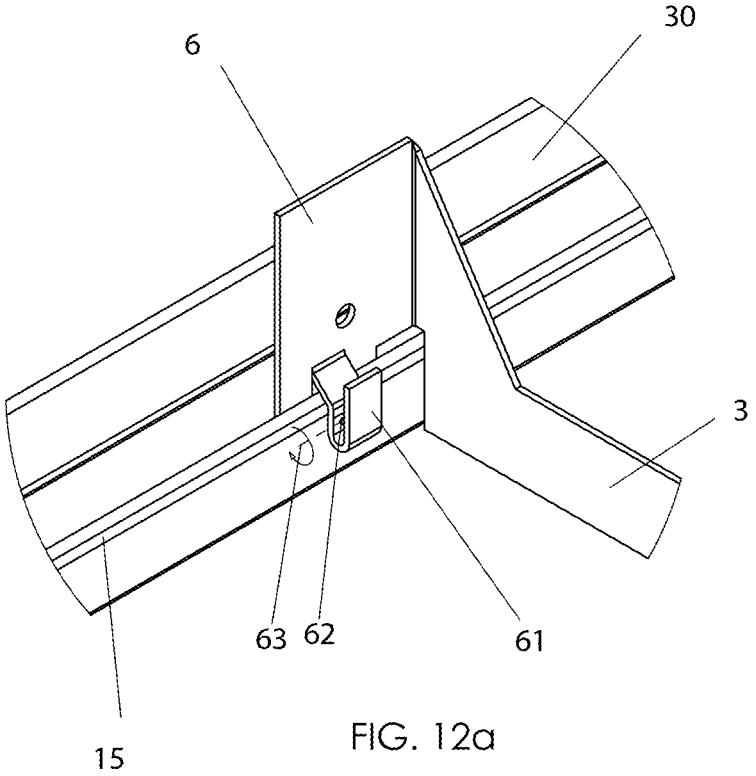
FIG. 12*a* is a perspective view from above of a support arm with a U-shaped locking element.

In FIG. 12*a*, U-shaped element 61 is seen prior to locking beneath hem 15 of channel 30. U-shaped element 61 is an extension of flange 6 of pot light support arm 3. Slot 62 in U-shaped element 61 runs parallel to channel 30 to create a localized weakness. A bend in U-shaped element 61 allows it to rotate about axis 63 beneath hem 15 of channel 30 to secure pot light support arm 3 in place. A flat head screwdriver or pliers, or the like, can be used to obtain leverage to bend U-shaped element 61 and secure it beneath hem 15.

Figure 13A:
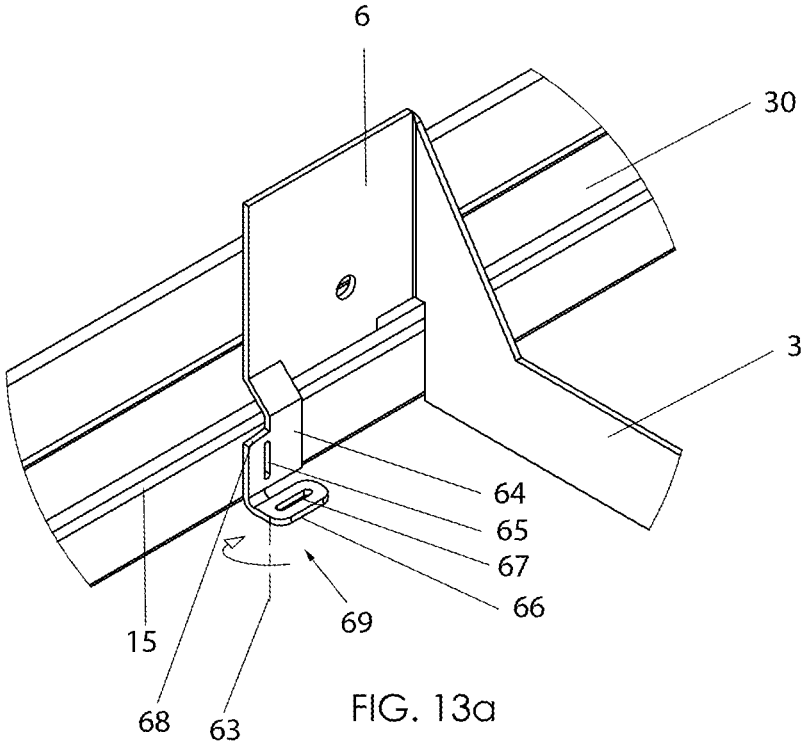
FIG. 13*a* is a perspective view from above of a support arm with a rotating sheet metal locking element.

A vertical axis sheet metal locking device 69 can be seen in FIG. 13*a*. Tab 64 extends from flange 6 of pot light support arm 3. Vertical slot 65 in tab 64 creates a localized weakness. A bend location in tab 64 allows angled edge 68 to rotate about axis 63 and wedge beneath hem 15 of channel 30 to secure pot light support arm 3 in position. Horizontally oriented tab 66 has slot 67 to receive a vertically oriented flat head screw driver from below for the purpose of rotating the locking device 69. Locking device 69 may be made of sheet metal or of a plastic injection molded part with a live hinge that snaps onto flange 6.

In this disclosure there are shown and described only exemplary embodiments of the invention and but a few examples of its versatility. It is to be understood that the invention is capable of use in various other combinations and environments and is capable of changes or modifications within the scope of the inventive concept as expressed herein. For example, the present disclosure has applicability for supporting various other ceiling fixtures, separately or in addition to pot lights, such as speakers, camera mechanisms, and like electrical devices. The size of the disclosed brackets may be made smaller or larger in accordance with joist spacing. In addition, the disclosed resilient channel embodiments can also be applied to walls to allow drywall to be flatter and sound transmission to be reduced across the wall. The term "drywall" as it appears throughout the disclosure should be understood to represent any appropriate substrate that can be used for enclosing building structure.

What is claimed is:

1. A resilient ceiling support system comprising:

a plurality of flexible channel structures for supporting at least one ceiling fixture, wherein each channel structure comprises:

a generally u-shaped channel comprising a substrate mounting surface for contact with and support of a ceiling substrate; and a plurality of unitary flexible hanger assemblies, each hanger assembly configured to interface with a corresponding channel;

wherein each flexible hanger assembly comprises a joist mounting portion configured for attachment to a ceiling joist having side surfaces and a bottom surface;

wherein the joist mounting portion comprises a right angle bend, a first section of the bend configured to be flush with a side surface of the joist and a second section of the bend configured to be flush with the bottom surface of the joist;

and the hanger assembly further comprises a u-shaped resilient cantilever element integral with the second section of the bend;

wherein each generally u-shaped channel comprises side walls extending upwardly from the substrate mounting surface, and an upper end of each side wall comprises a hem forming a downwardly facing slot with respect to the side wall.

2. A resilient ceiling support system as recited in claim 1, wherein the ceiling fixture comprises a pot light.

3. A resilient ceiling support system as recited in claim 1, wherein each flexible hanger assembly further comprises an upwardly extending mating portion for mating with a respective side wall slot, whereby the hanger assembly provides support for the u-shaped channel.

4. A resilient ceiling support system as recited in claim 3, wherein the upwardly extending mating portion comprises a hanger hook connected to an end of the cantilever, the hanger hook configured to interface with a respective slot of a generally u-shaped channel.

5. A ceiling support system as recited in claim 1, wherein the cantilever element comprises elastomeric material.

6. A flexible hanger assembly, for use in a substrate support system comprising:

a structure mounting portion;

a mating portion for mating with a channel structure; and a flexible element interconnecting the structure mounting portion and the mating portion; wherein:

the structure mounting portion is configured for attachment to a ceiling joist having side surfaces and a bottom surface, the structure mounting portion having a right angle bend, a first section of the bend configured to be flush with a side surface of the joist and a second section of the bend configured to be flush with the bottom surface of the joist; and the flexible element comprises a u-shaped cantilever element integral with the second section of the bend;

wherein the mating portion comprises a pair of retainers configured to interface with respective sides of the channel structure.

7. A flexible hanger assembly as recited in claim 6, wherein the cantilever element comprises elastomeric material.

8. A flexible hanger assembly for use in a substrate support system comprising:

a structure mounting portion;

a mating portion for mating with a channel structure; and a flexible element interconnecting the structure mounting portion and the mating portion; wherein:

the structure mounting portion is configured for attachment to a ceiling joist having side surfaces and a bottom surface, the structure mounting portion having a right angle bend, a first section of the bend configured to be flush with a side surface of the joist and a second section of the bend configured to be flush with the bottom surface of the joist; and the flexible element comprises a u-shaped cantilever element integral with the second section of the bend;

wherein the mating portion comprises hanger hooks connected to the cantilever element for engaging respective sides of the channel structure";.

9. A flexible hanger assembly, for use in a substrate support system comprising:

a structure mounting portion;

a mating portion for mating with a channel structure; and a flexible element interconnecting the structure mounting portion and the mating portion; wherein:

the structure mounting portion is configured for attachment to a ceiling joist having side surfaces and a bottom surface, the structure mounting portion having a right angle bend, a first section of the bend configured to be flush with a side surface of the joist and a second section of the bend configured to be flush with the bottom surface of the joist; and the flexible element comprises a u-shaped cantilever element integral with the second section of the bend; and further comprising an elastomeric isolator coupled to the cantilever element.

10. A flexible hanger assembly as recited in claim 9, wherein the isolator comprises hanger hooks.

* * * * *